US008608015B2

(12) United States Patent
Wolf et al.

(10) Patent No.: US 8,608,015 B2
(45) Date of Patent: Dec. 17, 2013

(54) DEVICE FOR STORING BEVERAGES

(75) Inventors: Tracy C. Wolf, St. Charles, IL (US); Sarah E. Kaiser, North Aurora, IL (US)

(73) Assignee: Innovative Plastech, Inc., Batavia, IL (US)

( * ) Notice: Subject to any disclaimer, the term of this patent is extended or adjusted under 35 U.S.C. 154(b) by 0 days.

(21) Appl. No.: 13/416,548

(22) Filed: Mar. 9, 2012

(65) Prior Publication Data

US 2013/0233011 A1 Sep. 12, 2013

(51) Int. Cl.

| | |
|---|---|
| ***B65D 1/24*** | (2006.01) |
| ***B65D 85/00*** | (2006.01) |
| ***B65D 81/38*** | (2006.01) |
| ***F25D 3/08*** | (2006.01) |

(52) U.S. Cl.

USPC ..... 220/592.16; 220/507; 220/509; 220/513; 220/516; 220/592.17; 220/737; 220/740; 62/457.1; 62/457.5

(58) Field of Classification Search

USPC ..... 220/507, 509, 513, 515, 516, 519, 220/574.2, 592.16, 592.17, 737, 740; 62/457.1, 457.4, 457.5, 457.8; 206/427

See application file for complete search history.

(56) References Cited

U.S. PATENT DOCUMENTS

| | | | | |
|---|---|---|---|---|
| 991,715 | A | 5/1911 | Good | |
| 3,605,435 | A | 9/1971 | Taylor | 62/457 |
| 4,286,440 | A | 9/1981 | Taylor | 62/457 |
| 4,344,300 | A * | 8/1982 | Taylor | 62/457.5 |
| 4,704,875 | A * | 11/1987 | Kieler | 62/372 |
| 4,899,553 | A | 2/1990 | Drummond, III | 62/372 |
| 5,546,818 | A | 8/1996 | Keefer | 73/863 |
| 6,065,303 | A | 5/2000 | Harris | 62/457.5 |
| 6,360,558 | B1 | 3/2002 | Woog | 62/457.5 |
| 6,481,014 | B1 | 11/2002 | Banks et al. | 62/457.4 |
| 7,097,034 | B2 | 8/2006 | Woog | 206/427 |
| 7,121,112 | B2 * | 10/2006 | Robertson | 62/457.5 |
| 7,882,706 | B2 | 2/2011 | Thali et al. | 62/72 |
| 8,505,726 | B1 * | 8/2013 | Woog | 206/457 |
| 2011/0252824 | A1 | 10/2011 | Dallas et al. | 62/457.5 |

OTHER PUBLICATIONS 9 photographs of an 18-bottle container having vertical sidewalls and no container-retaining pockets, which is believed to have been publicly displayed prior to Mar. 9, 2011.

* cited by examiner

*Primary Examiner* — Anthony Stashick

*Assistant Examiner* — Madison L Poos

(74) *Attorney, Agent, or Firm* — Brinks Gilson & Lione

(57) ABSTRACT

A device capable of storing beverages is provided with a base and a lid. The base includes a central cavity capable of retaining beverage containers and a cooling component. The bottoms of beverage containers may rest in container-retaining pockets molded into the bottom of the base and the tops of beverage containers may rest in one or more pockets protruding from the lid. One advantage is that the beverage containers may come into direct contact with the cooling component located in the central cavity of the base of the device.

19 Claims, 27 Drawing Sheets

DEVICE FOR STORING BEVERAGES

BACKGROUND

1. Field of the Invention

The present invention relates generally to beverage containers and more particularly to containers configured for storing both beverages and cooling component(s).

2. Description of the Related Art

Portable cooling containers are useful for transporting food and beverages for consumption, particularly for consumption during outdoor activities. Such portable containers for cooling food and beverages often include layers of insulating material, a central storage area suitable for storing food or beverages and a cooling component such as ice cubes and/or an ice pack.

Many portable cooling containers are constructed of a combination of water-tight plastic outer layers coupled with insulating central layers. Given the cost of construction, such containers are typically too expensive for disposable use. Due to their complex construction, such containers are also often bulky and relatively heavy.

Disposable portable cooling containers are frequently composed of an insulating material such as polystyrene alone—without an outer plastic layer. Due to the lack of a protective plastic layer, these containers break easily. Such polystyrene containers are also bulky, prone to leaking, and make squeaking noises when transported. Further, polystyrene is non-biodegradable and not accepted in many recycling programs.

In both reusable and disposable portable cooling containers, the central storage area of portable cooling containers typically has a generally rectangular shape. Over time, food or beverages stored in the space may slide around within the storage area, making a particular item difficult to locate and retrieve when desired. Food and beverages may also contact each other within the storage area. This may be problematic when the cooling container is being used to store glass bottles or other frangible containers, which may chip or break when they contact each other in the course of ordinary use and transport of the cooling container.

Both reusable and disposable portable cooling containers typically are opaque due to the opaque nature of common insulating materials such as polystyrene. Thus, they are not ideal for displaying food or beverages for display and sale. In addition, the materials are frequently too expensive to allow for disposable use, making them impractical for containing beverages for retail sale.

BRIEF SUMMARY

A device configured for storing beverages is described. The device may include a base having a top portion and bottom portion. The base also may include a central cavity configured for retaining at least one container and a cooling component. Container-retaining pockets may be molded into the bottom portion of the base. The lid of the device may include a top surface and a bottom surface that is configured to conformingly and matingly fit the top portion of the base. Pockets suitable for retaining the top portion of a container may protrude from the lid.

The device may be configured for retaining at least three containers such that the containers may come into contact with the cooling component located in the central cavity. The bottom of the containers may be retained in one of the container-retaining pockets in the bottom portion of the base and a top portion of the containers may be retained in one of the pockets in the lid. One advantage of the device's configuration of container-retaining pockets is that beverages stored in the device may come into contact with the cooling component, thus keeping the beverages cool.

The invention may include any of the following aspects in various combinations and may also include any other aspect described below in the written description or in the attached drawings.

The base of the device may be integrally formed.

The device may be composed of transparent thermoplastic.

The device may include six container-retaining pockets arranged in a generally circular configuration. The device may also include twelve container-retaining pockets arranged in a generally circular configuration.

The device may be configured for containing glass bottles. Additionally, the device may be configured for retaining cans. Such embodiments may be specifically dimensioned and/or shaped to accommodate standard and/or specialty containers such as bottles, cans, or the like.

The container-retaining pockets of the device may each be structured to retain a container in an angled position such that the center of the top portion of the container is further away from the center of the device than the center of the bottom portion of the container. Further, each of the container-retaining pockets may be structured to retain a container in an angled position such that the top portion of the container is tilted to one side relative to the bottom portion of the container.

The device may include a bottom flange protruding from the top portion of the base, a top flange protruding from a bottom portion of the lid; and at least one attaching means configured for reclosably attaching the bottom flange and the top flange. The attaching means may comprise a first undercut located on the bottom flange and a second undercut located on the top flange. In such embodiments, the first undercut may be configured for mating with the second undercut to form a reclosable seal.

The device may also include at least one raised elongate area formed in the bottom flange and at least one raised elongate area formed in the top flange. The raised elongate areas on the bottom flange and top flange may be aligned when the device is in a closed position such that the elongate areas on the flanges together form at least one handle.

The device may include at least one raised elongate area formed in the bottom flange that merges with a side of the lid. Similarly, a raised elongate area formed in the top flange may merge with a side of the base.

The top surface of the lid of the device may be molded to fit the bottom portion of the base such that the bottom portion of the base is configured for resting between the pockets protruding from the lid when the base is stacked on top of the lid. This feature may also allow ease and security of stacking multiple devices.

The pockets protruding from the lid of the device may be connected together to form a single ring-like protrusion on the lid.

The device may include a generally flat portion on the top of the lid that is configured for serving as a resting place for at least one container upon the container's removal from the central cavity of the device.

The device configured for storing generally cylindrical containers may include a base having a top portion and a bottom portion in which the bottom portion forms a cavity. A plurality of container-retaining pockets may be molded into the bottom portion of the base in a generally circular configuration, each container-retaining pocket being configured for retaining a bottom portion of a container. The centermost portion of the cavity formed by the bottom portion of the base may be positioned at the center of the container-retaining pockets and be suitable for storing a cooling component. The device may further include a lid having a top surface and a bottom surface, the lid configured for conformingly and matingly being attached to the top portion of the base. A raised portion may protrude from the top surface of the lid and have a ring-like configuration. In such embodiments, the device may be configured to securely retaining a plurality of containers such that the bottom portion of each container rests in a container-retaining pocket in the base and the top portion of each container rests in the raised portion of the top surface of the lid.

The device configured for storing generally cylindrical containers may also comprise an integrally formed plastic base. The base may include a top portion and a bottom portion that forms a cavity. A plurality of container-retaining pockets may be molded into the bottom portion of the base, each of which is configured to conformingly retain a container having a top portion and a bottom portion at an angle such that the bottom portion of each container is located closer to the center of the device than the top portion. The centermost portion of the cavity formed by the bottom portion of the base of the device may be positioned at the center of the container-retaining pockets and be suitable for storing a cooling component. In such embodiments, the base may be configured to retain the plurality of containers in a generally circular configuration such that the containers may come into contact with the cooling component. Further, the base may be configured such that it may be conformingly and matingly attached to a lid having at least one raised portion protruding from its top surface that is configured to contain the top portion of each container.

DETAILED DESCRIPTION OF THE PREFERRED EMBODIMENTS

Figure 1:
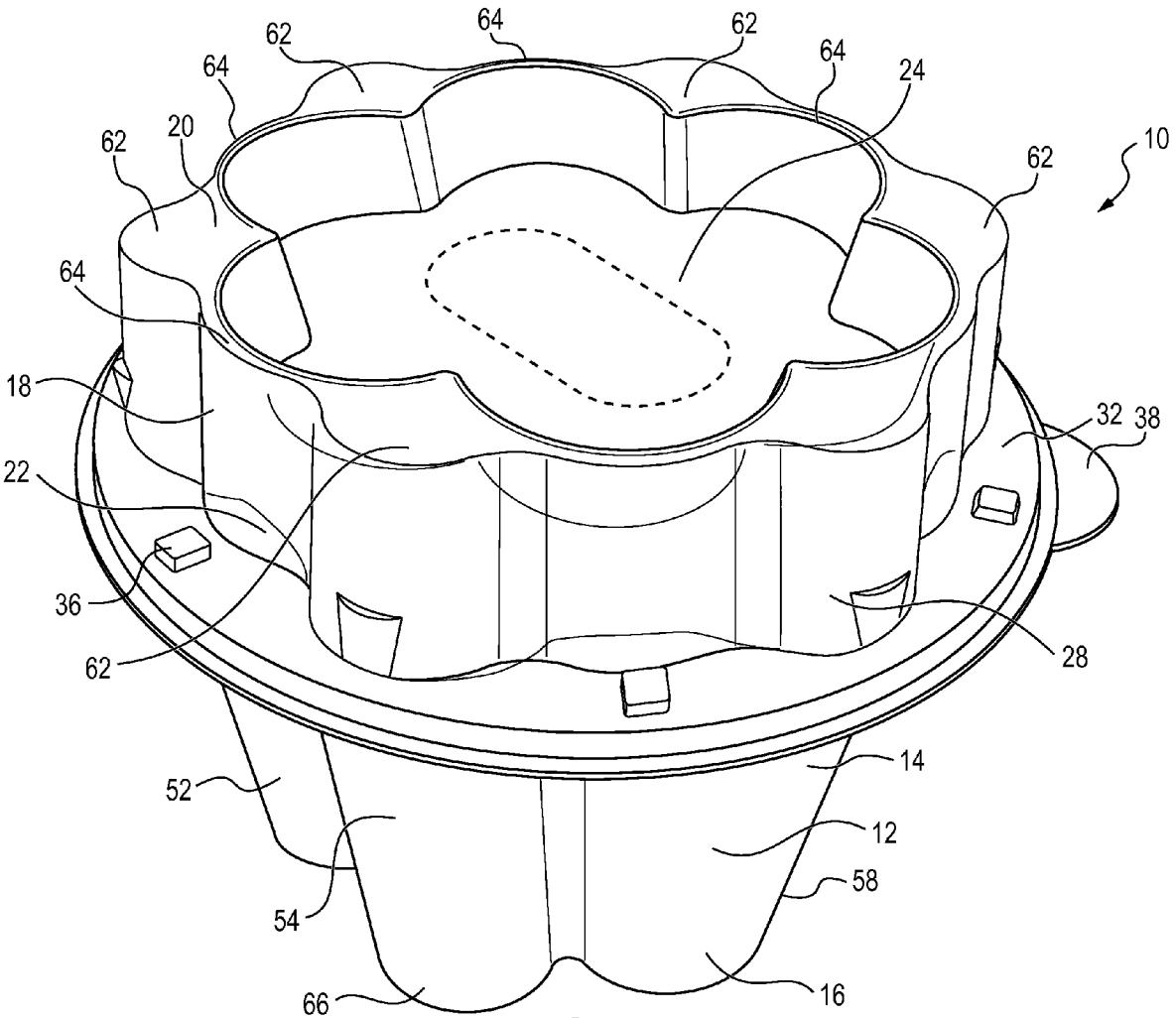
FIG. 1 is a top perspective view of one embodiment of a device for storing beverages.

Referring now to the drawings, and particularly to FIG. 1, a device 10 configured for storing generally cylindrical containers such as, for example, bottles or cans containing beverages, is shown. The device 10 includes a base 12 having a top portion 14 and a bottom portion 16. The base 12 includes a central cavity configured to retain at least one container, such as a bottle or can, as well as cooling component, such as ice cubes and/or an ice pack (defined here to include actual ice, or any number of preformed and/or prepackaged devices commonly known and used for chilling and/or keeping items cool). The base 12 of the embodiment shown in FIG. 1 also includes six container-retaining pockets 54 molded into the bottom portion 16 of the base 12.

The embodiment shown in FIG. 1 also includes a lid 18 having a top surface 20 and a bottom surface. As shown in FIG. 1, the lid 18 is configured to be attached to the top portion 14 of the base 12. The lid 18 shown in FIG. 1 includes a pocket 22 protruding from the lid 18, which is suitable for retaining the top portion of at least one container, such as a bottle or a can.

The embodiment depicted in FIG. 1 is configured to retain at least one container such that the container may come into direct contact with a cooling component located in the central cavity. The embodiment is also configured such that the bottom portion of each container is capable of being retained in one of the container-retaining pockets 54 in the bottom portion 16 of the base 12 and the top portion of each container is capable of being retained in the pocket 22 in the lid 18.

As depicted in FIG. 1, the device 10 may include one or more tabs 38, 40, which may be used to assist a user in opening the device. In the embodiment shown in FIG. 1, the lid 18 includes a first tab 38 and the base 12 includes a second tab 40, each of identical size and configuration. Having mirror-image tabs on the lid 18 and base 12 may be advantageous because it allows a user to visually determine how to align the lid 18 and base 12 when closing the device 10. This may be particularly useful in embodiments in which the lid 18 and base 12 feature interfitting closures such as the vertical protrusions 36 depicted in FIG. 1. In other embodiments, the lid and or base may each have multiple mirror-image tabs, the tabs may not be mirror-images, only the lid may have a tab, only the base may have a tab, or neither the lid nor base may include any tabs. For example, several exemplary embodiments lacking tabs are depicted in FIGS. 9-19.

The tabs 38, 40 depicted in FIG. 1 have a generally semi-circular shape and protrude approximately one inch from the periphery of the flange 32 encircling the embodiment. The rounded shape of the tabs 38, 40 may be advantageous because there are no sharp edges on which users could injure themselves. The one-inch size of the tab may also be advantageous because it provides a user with a sufficiently large area to grasp the tab. However, in other embodiments, the tabs may have a different shape or size, preferably shaped and dimensioned for ease of grasping.

Figure 2:
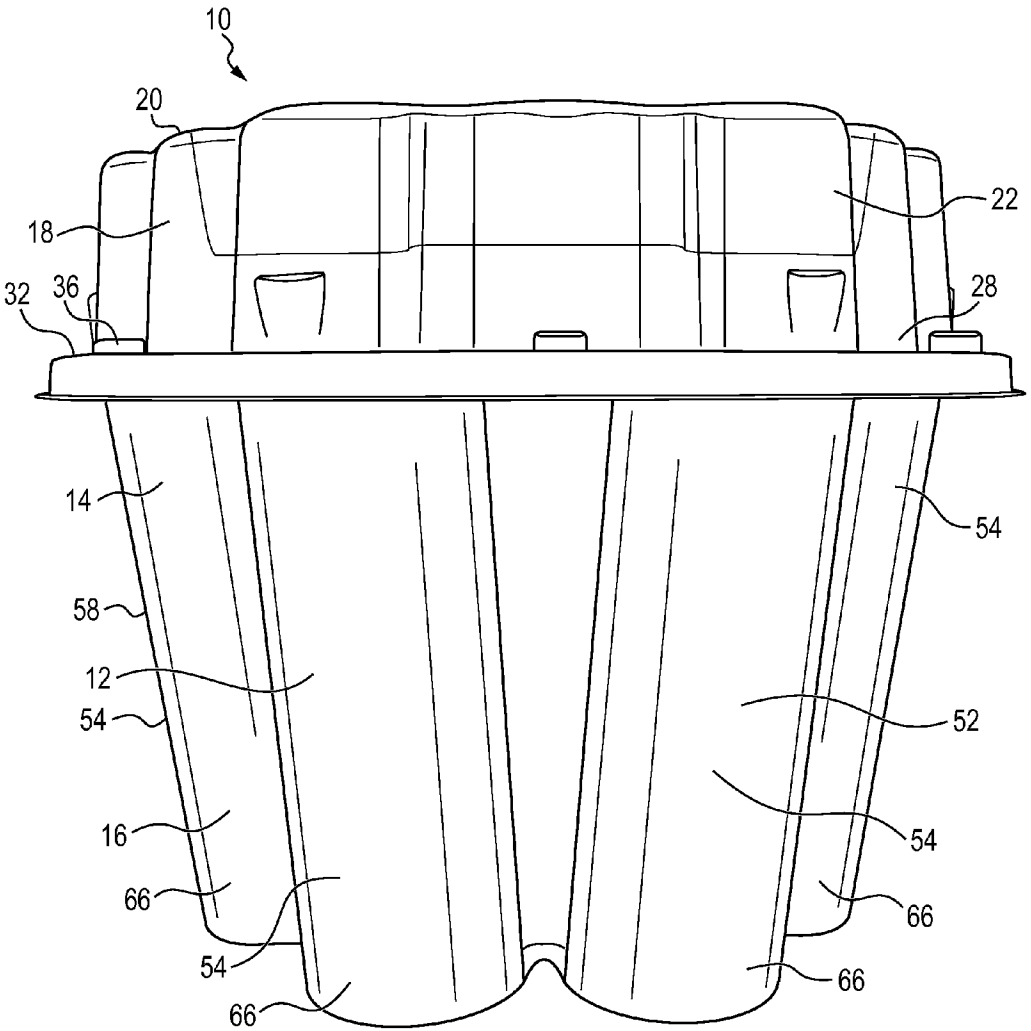
FIG. 2 is a side elevation view of the embodiment shown in FIG. 1.

As shown in FIG. 1, the exterior of the base 12 of the device 10 includes multiple contoured areas 52, which define container-retaining pockets 54 within the central cavity. As best seen in FIG. 2, the container-retaining pockets 54 preferably have an angled surface 58 that slopes outwardly from the bottom portion 16 of the base 12 toward the top portion 14 of the base 12. As shown, each of the container-retaining pockets 54 in the bottom portion 16 of the base 12 is preferably structured to retain a container in an angled position such that the top portion of the container is further away from the center of the device than the bottom portion of the container. This angling allows for the device to have a wider top than base, which may facilitate securely stacking the devices. The angled surface 58 depicted in FIG. 2 is exemplary; other embodiments may have steeper or more gradually angled surfaces. In the embodiment depicted in FIG. 2, the angled surface 58 for each container-retaining pocket 54 is consistent with the other container-retaining pockets. However, in other embodiments, the steepness of the angled-surface 58 may vary between container-retaining pockets 54. Although it is preferable that the container-retaining pockets have an angled surface, other embodiments will include container-retaining pockets designed to hold containers in a straight vertical position.

The use of an angled surface 58 like that depicted in FIG. 2 may also be advantageous because it allows for multiple bases to be compactly stacked together. This may be advantageous for distributors and retailers because it may allow for large quantities of the device to be shipped or transported to point-of-sale or packing locations without requiring bulky packaging. The devices may then be stocked with beverages and the lids added at the point-of-sale or packing location. This may be particularly advantageous for beverage sales at festivals, concerts, or other seasonal outdoor events where shelving for display is not available.

Figure 3:
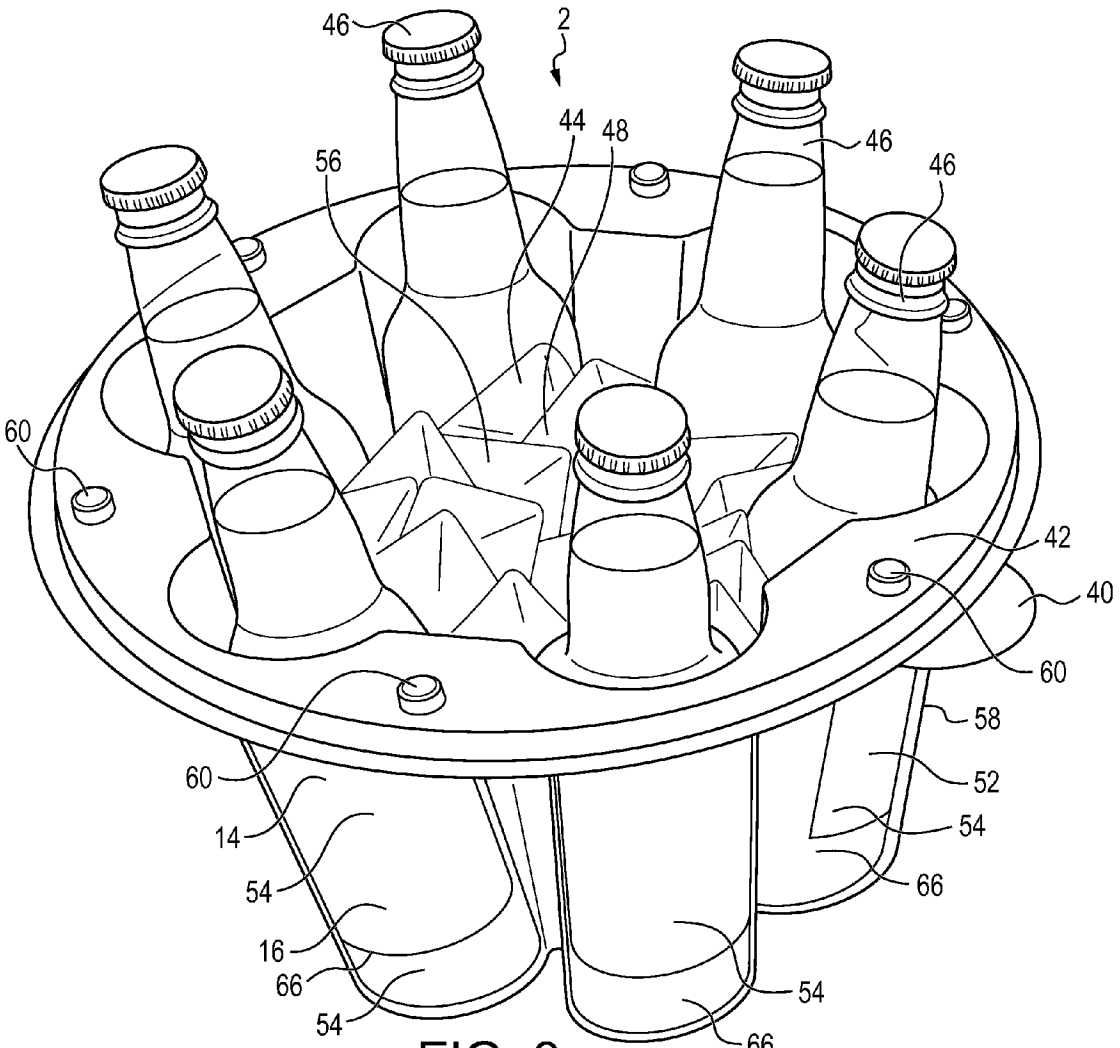
FIG. 3 is a perspective view of a base of the embodiment shown in FIG. 1, shown with beverage bottles and an example of a cooling component.

FIG. 3 illustrates the base 12 of the device 10 being used to store six containers 46 and cooling component 48 within the central cavity 44. In other embodiments, the device may be configured to store fewer or more containers. For example, in other embodiments, the device may be configured to have as few as three container-retaining pockets. Other embodiments may have ten, twelve, twenty-four, or more container retaining pockets.

In the embodiment depicted in FIG. 3, the exemplary containers 46 are shown as glass bottles and the cooling component 48 is shown as ice cubes. However, the device 10 may be adapted to store a variety of different types of containers, including cans, vials, plastic bottles, or glass bottles of variable size and shape. The cooling component utilized may also vary. Suitable cooling components include but are not limited to ice cubes, ice packs, dry ice, pre-formed cold-packs, or liquid or gas coolants. Custom-shaped cold-packs formed of and/or filled with a known coolant fluid, gel, or other material may be provided to fit different embodiments described herein. For example, a retail seller may have a mold for making monolithic ice cubes in a shape configured to occupy the central space 44 around a selected plurality of beverage containers.

Figure 4:
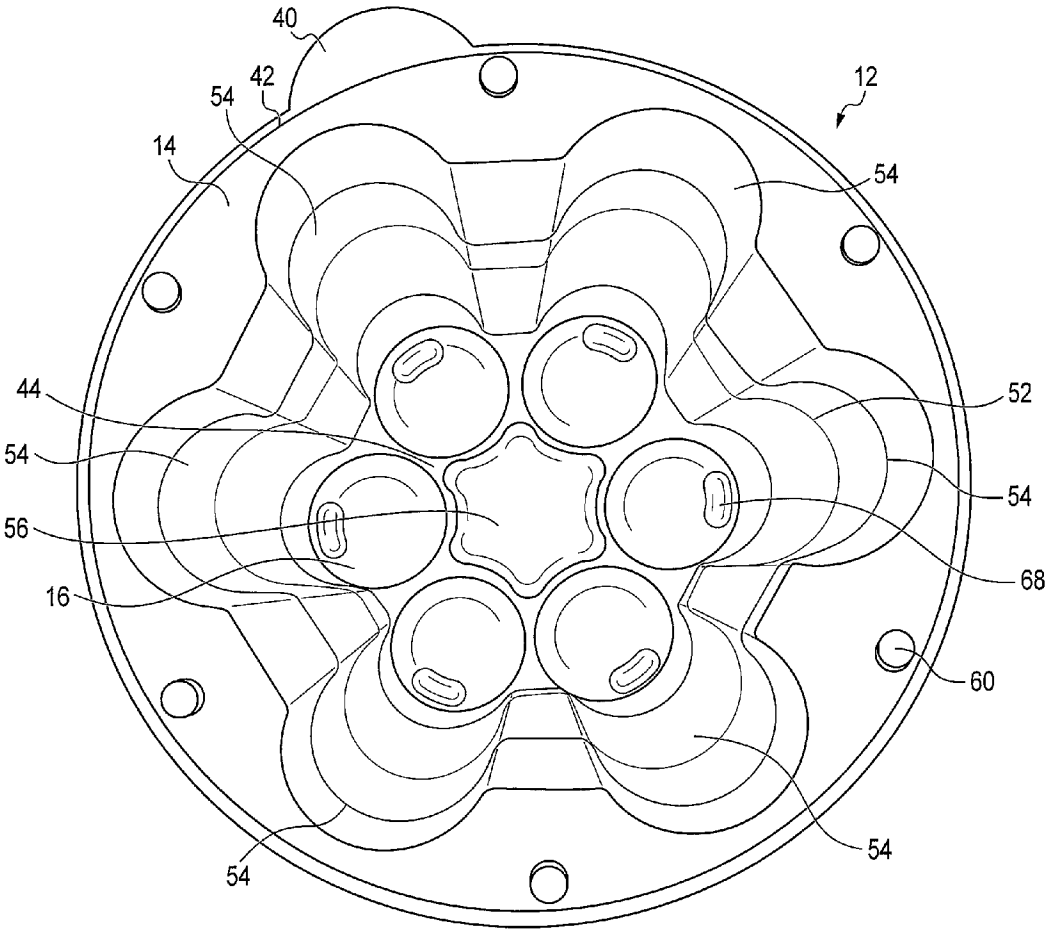
FIG. 4 is a top plan view of the base of the embodiment shown in FIG. 1.

As shown in the depiction of the base 12 of the device 10 in FIG. 4, the container-retaining pockets 54 are preferably arranged in a generally circular configuration within the central cavity 44. The floor of the base 12 between the circular configuration of container-retainer pockets 54 may be somewhat raised in order to provide support. However, the center-most area 56 of the central cavity 44 between the container-retaining pockets 54 is preferably generally empty to allow space for the cooling component. As shown in FIG. 4, no barriers or dividers separate the container-retaining pockets 54 from one another or from the center-most area 56 of the central cavity 44 where the cooling component may be stored. Thus, the containers may come into direct or indirect contact with the cooling component. The lack of barriers or dividers between the container-retaining pockets 54 may be advantageous because it allows for open space between the containers in which the cooling component may permeate.

FIGS. 1-4 illustrate one embodiment of a mechanism for attaching the base 12 of the device 10 with the lid 18 of the device 10. As shown in FIGS. 3 and 4, the base 12 may include a bottom flange 42 protruding from the top portion 14 of the base 12. The bottom flange 42 may have one or more vertical protrusions 60 forming the male portion of a button snap. As shown in FIGS. 1 and 2, the lid 18 may include a top flange 32 protruding from the bottom portion 28 of the lid 18. The top flange 32 may have one or more vertical protrusions 36 forming female portions of button snaps. When the vertical protrusions 36 on the top flange 32 (female portions) are aligned with the vertical protrusions 60 on the bottom flange 42 (male portions) and pressed together, the cavities formed by the vertical protrusions 36 on the top flange 32 receive the vertical protrusions 60 on the bottom flange 42 to create button snaps. Alternatively, or in addition, the top flange may have one or more male portion of a button snap that is configured to be received by one or more female portion on the bottom flange. In addition to the use of button snaps, other mechanisms for attaching the bottom flange of the base and the top flange of the lid may include inter-fitting teeth, hinges, undercuts, snaps, heat sealing, radio frequency sealing, glue, adhesives known in the art, or any other attaching mechanism. Any such mechanism for attaching the base and lid may be used alone or in combination with one or more other mechanisms.

For embodiments having a pair of mating protrusions that work together to form one or more button snaps, the button snaps may be square, circular, semi-circular, ovular, polygonal, triangular, oblong, or have any other shape known in the art. The protrusions may also be custom-shaped for particular brands of beverages being sold in the beverage containing devices. In still other embodiments, the protrusions may be sized and shaped such that they double as handles for conveniently gripping the device.

The mechanism for attaching the base and the lid is preferably resealable to allow for the device to be reclosed for continued use to cool beverages. However, in some embodiments, non-resealable mechanisms such as heat-sealing or glue may be used. In still other embodiments, the base and lid may be connected to one another by one or more hinges. Still other embodiments may utilize a combination of one or more sealing mechanism, e.g., a hinge coupled with a non-resealable mechanism or a hinge coupled with nesting protrusions.

Figure 5:
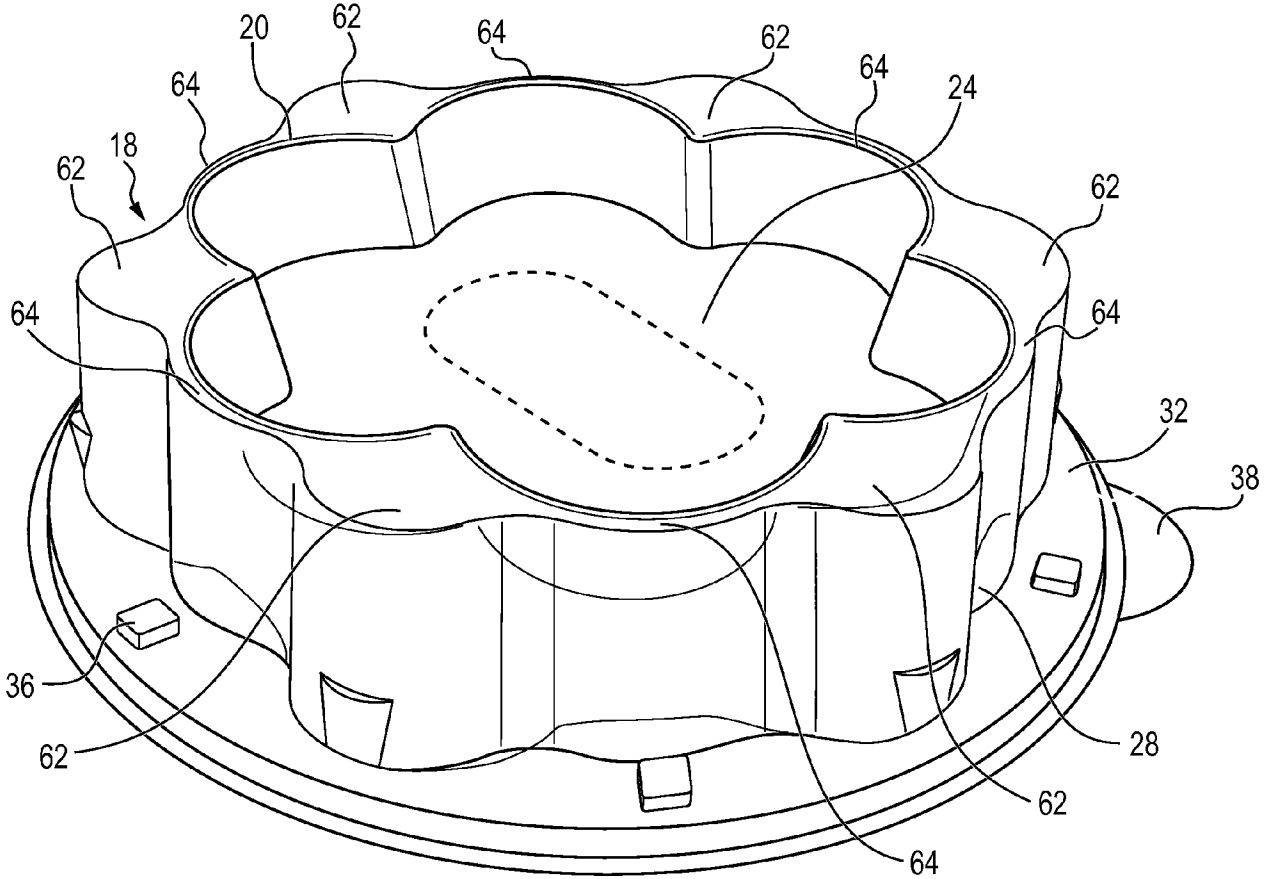
FIG. 5 is a perspective view of a lid of the embodiment shown in FIG. 1.
Figure 6:
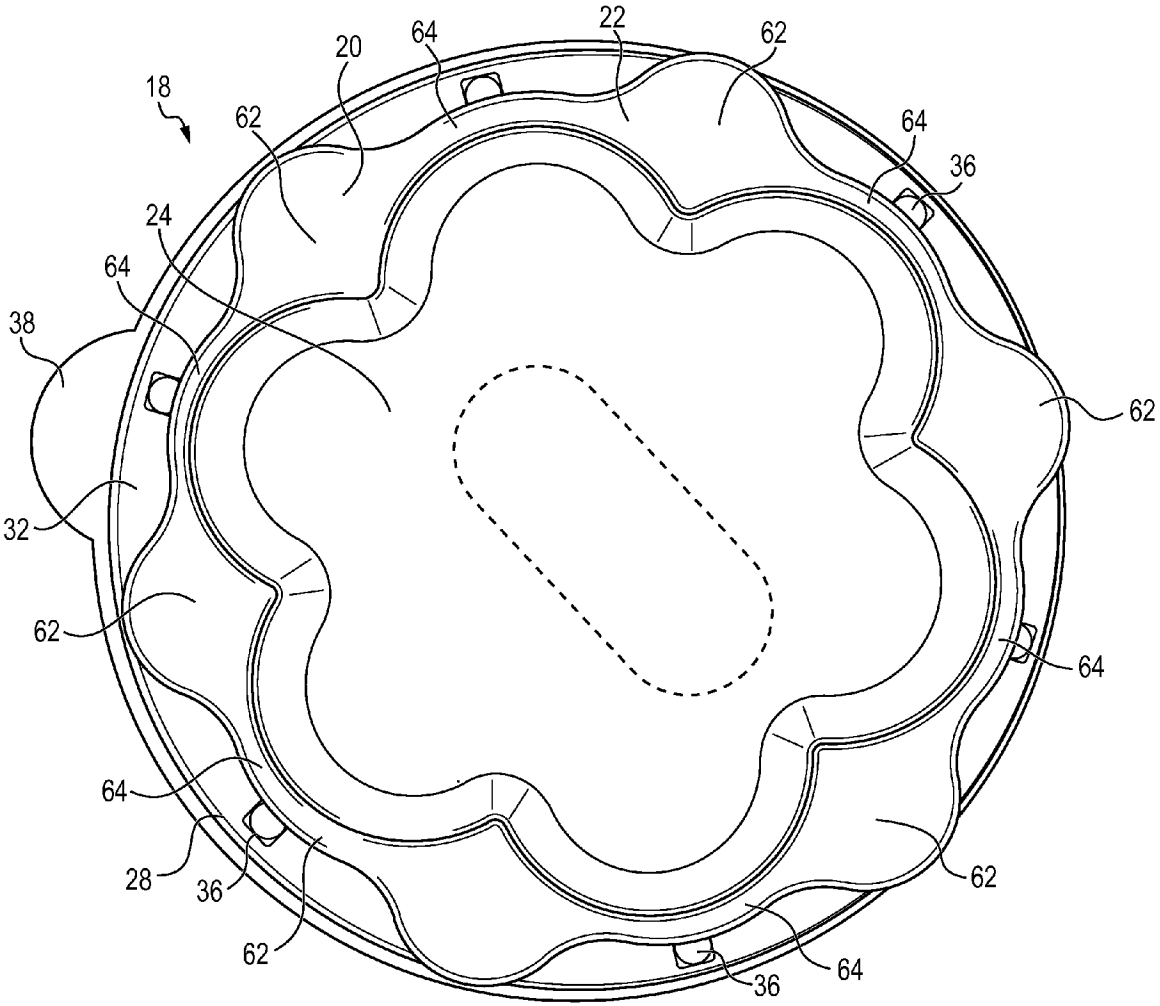
FIG. 6 is a top plan view of a lid of the embodiment shown in FIG. 1.

FIGS. 5 and 6 show the lid 18 of the device 10 depicted in FIG. 1. As shown, the lid 18 may include a generally flat portion 24 on the top surface 20 of the lid 18. The flat portion 24 may serve as a resting place for one or more containers upon their removal from the central cavity 44 of the device 10. Thus, the device 10 may double as a convenient portable table-top for use when consuming the beverages or food stored within the device. Further, the pocket(s) 22 protruding from the lid 18 preferably encircle the flat portion 24 and thus may serve to corral the containers, reducing the risk of spilling.

In the embodiment of the lid shown in FIGS. 1, 2, 4, 5 and 6, the pockets 22 protruding from the lid 18 are connected together to form a single ring-like raised portion. The ring-like raised portion includes pockets 22 composed of wide areas 62 of the raised portion, which are linked to one another by narrow connecting areas 64. In other embodiments, the pockets may not be linked together. In still other embodiments, the pockets may be linked together by raised connecting areas of equal or greater width than the pockets themselves. The ring-like raised portion shown in FIGS. 1, 2, 4, 5 and 6 has a consistent height. However, in other embodiments, the height of the ring-like raised portion may vary such that the narrow connecting areas are lower or higher than the wide pockets.

The flat portion 24 on the top surface 20 of the lid 18 may also provide a convenient location for placing product information regarding the food or beverages packaged within the device 10. Brand information may be molded directly into the flat portion 24 of the top surface 20 of the lid 18. Alternatively, paper or card stock containing product information may be designed to fit over the flat surface 20.

Figure 7:
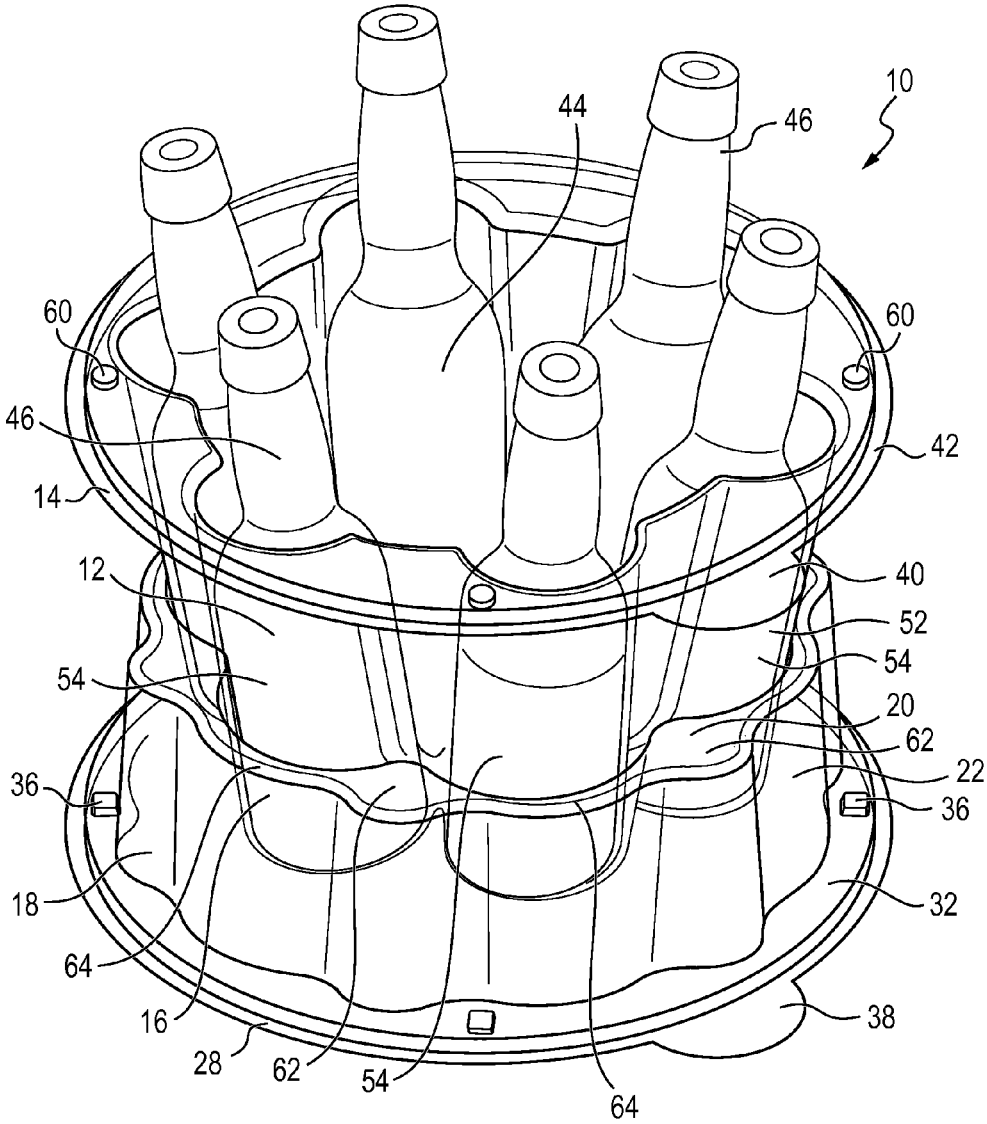
FIG. 7 is a perspective view of the base of the embodiment shown in FIG. 1, resting on top of a lid of a device for storing beverages.
Figure 7A:
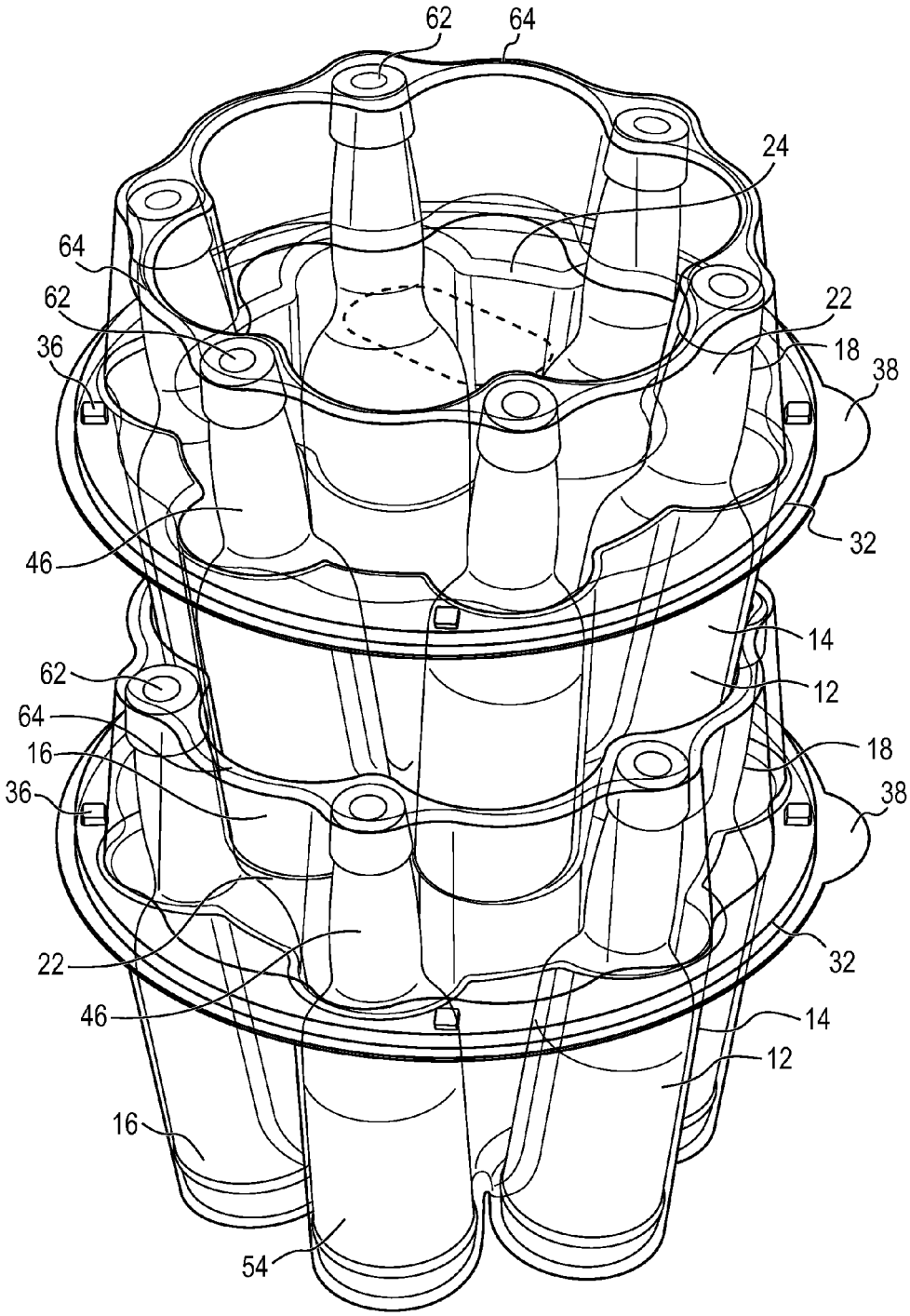
FIG. 7A is a perspective view of two of the embodiments shown in FIG. 1, with the second one resting on and nested into the top of the first.

FIG. 7 illustrates the bottom portion 16 of the base 12 resting on the top surface 20 of the lid 18. As shown in FIG. 7, the pocket(s) 22 on the lid 18 are preferably molded to fit the bottom portion 16 of the base 12 such that the base 12 cannot slide or move relative to the lid 18 when resting on top of the lid 18. This may be advantageous because it allows for the lid to be conveniently stored when the device is in use. Also, the interfitting relationship between the lid 18 and the base 12 of the device 10 minimizes the risk of slippage when multiple devices are stacked one on top of another as shown in FIG. 7A. This interfitting relationship may be advantageous for transporting the devices or displaying the devices with beverages for sale at retail locations. Thus, multiple devices may be stacked in a retail location with no need for additional shelving in order to create a secure and attractive display for sale. This may be particularly useful for temporary displays at outdoor locations such as concerts or festivals or for displaying products at special promotional events.

Figure 8:
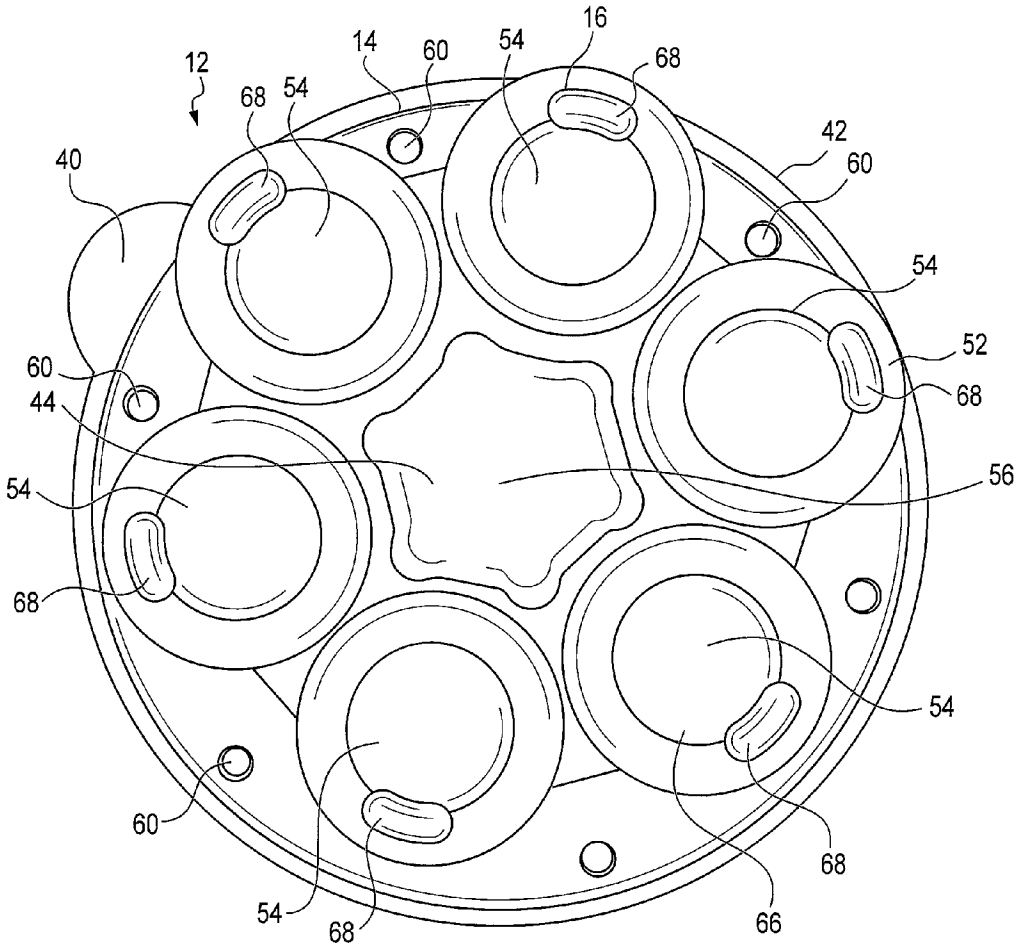
FIG. 8 is a bottom plan view of the embodiment shown in FIG. 1.

FIG. 8 depicts the bottom of the base 12 of the device 10, including the generally circular relationship of the embodiment's six container-retaining pockets 54. In this embodiment, the bottom 66 of each container-retaining pocket 54 features a slightly recessed area in the center. As shown in FIG. 8, the outside periphery of the bottom 66 of each container-retaining pocket 54 may also feature a foot 68 consisting of an ovular protrusion. When in use, the device 10 may rest on these feet 68.

As shown in FIG. 8, each foot 68 may be generally ovular in shape and slightly curved to match the shape of the bottom 66 of the container-retaining pocket 54 on which it is located. The feet also may be square, rectangular, circular, semi-circular, polygonal, or have any other shape known in the art. The feet may also be custom-shaped to promote a particular brand.

The presence of feet like those shown in FIG. 8 is optional. Thus, other embodiments may feature fewer feet (i.e., not every container retaining pocket may have a foot located on the bottom) or no feet on the bottom of any the container-retaining pockets. In embodiments having feet, the device 10 may have feet 68 with the same shape and size on each container retaining pocket 54 as shown in FIG. 8, or alternatively, the size and shape of the feet may vary between container-retaining pockets.

Figure 9:
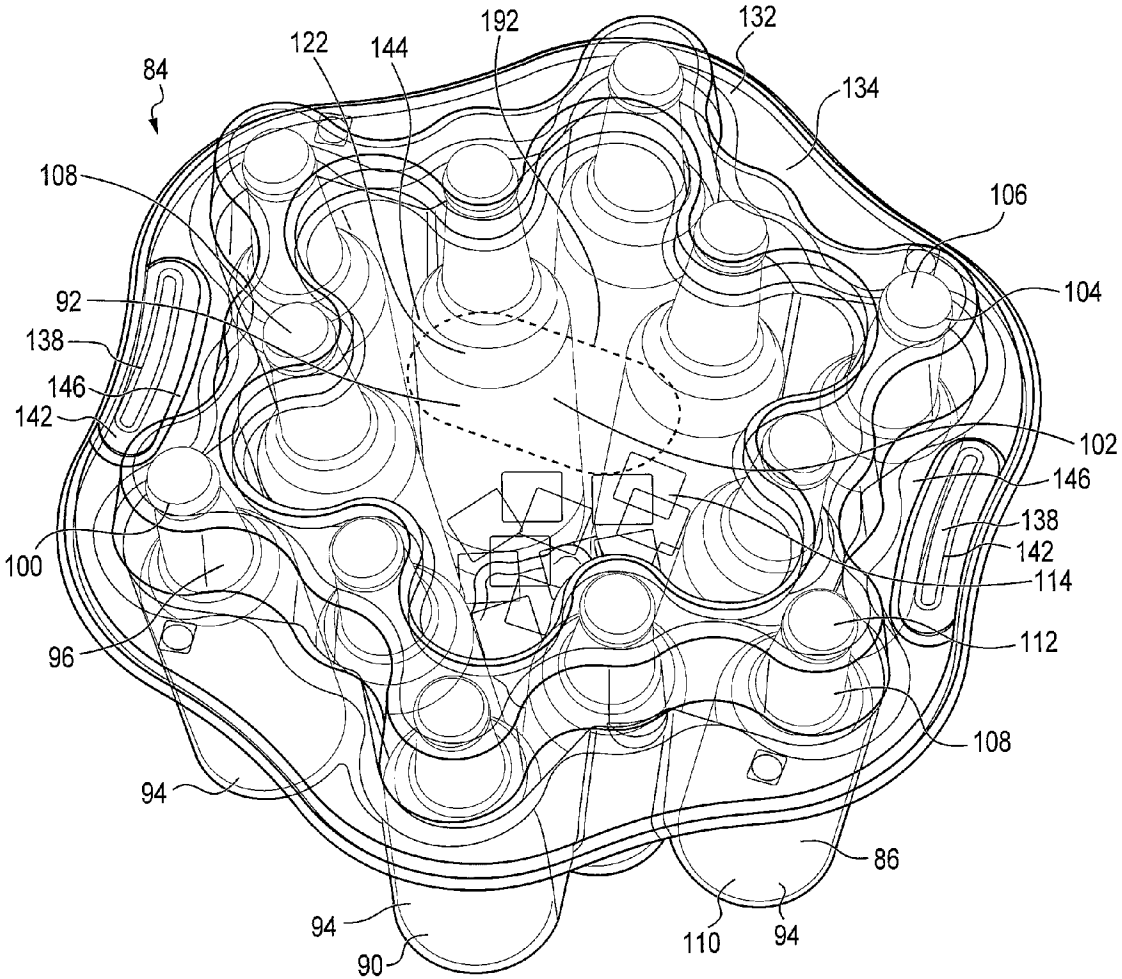
FIG. 9 is a perspective view of an embodiment of a device for storing twelve beverages or other items, shown with beverage bottles and an example of a cooling component.

FIG. 9 illustrates another embodiment of a device 84 configured for storing generally cylindrical containers. The device 84 includes a base 86 having a top portion 88 and a bottom portion 90, which defines a cavity 92. A plurality of container-retaining pockets 94 are molded into the bottom portion 90 of the base 86 in a generally circular configuration. Each container-retaining pocket 94 is suitable for retaining the bottom portion 90 of a container. A centermost portion 102 of the cavity 92 of the base 86 is located at the center of the circular configuration of container-retaining pockets 94.

The embodiment depicted in FIG. 9 also includes a lid 96 having a bottom surface and a top surface 100, which includes a raised portion 104 protruding therefrom that has a ring-like configuration 106. The lid 96 is configured to be conformingly and matingly attached to the top portion 88 of the base 86.

The device depicted in FIG. 9 is configured to securely retain a plurality of containers 108 such that the bottom portion 110 of each container 108 rests in a container-retaining pocket 94 in the base 86 and the top portion 112 of each container 108 rests in the raised portion 104 of the top surface 100 of the lid 96. Further, the device 84 is configured to retain the plurality of containers 108 in a generally circular configuration and the centermost portion 102 of the cavity 92 is suitable for storing a cooling component 114.

Figure 10:
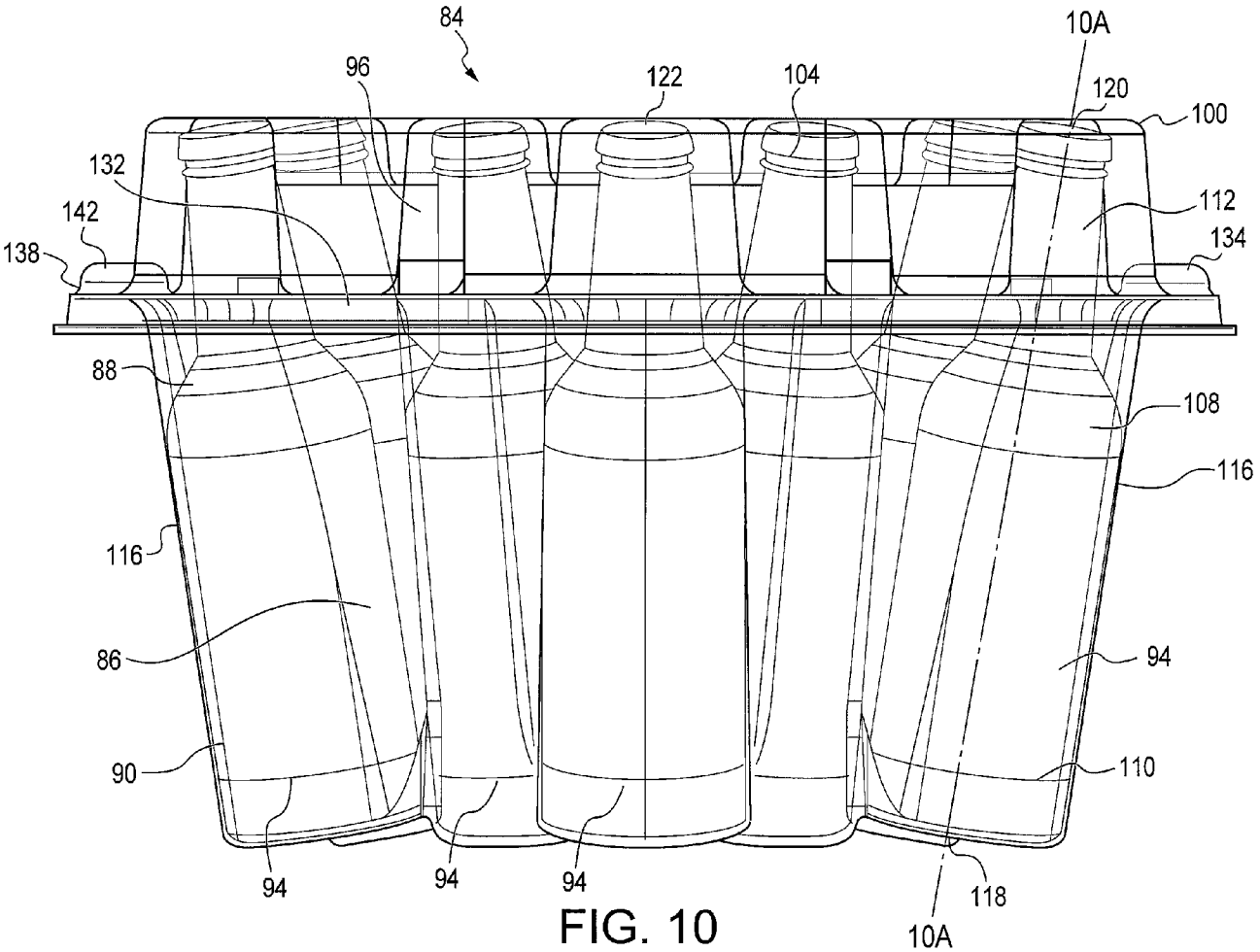
FIG. 10 is a side elevation view of the embodiment shown in FIG. 9.

As best seen in FIG. 10, the container-retaining pockets 94 may have an angled surface 116 that slopes outwardly from the bottom portion 90 of the base 86 to the top portion 88 of the base 86. As shown, each of the container-retaining pockets 94 in the bottom portion 90 of the base 86 is preferably structured to retain a container in an angled position such that the center 120 of top portion 112 of the container is further away from the center 122 of the device than the center 118 of the bottom portion 110 of the container. This angling is illustrated by exemplary line 10A-10A which runs through the geometric center of one of the containers depicted in FIG. 9. The angling allows for the device 84 to have a wider top than base, which may facilitate securely stacking multiple devices together.

The angled surface 58 depicted in FIG. 2 is exemplary; other embodiments may have steeper or more gradually angled surfaces. In the embodiment depicted in FIG. 10, the angled surface 116 for each container-retaining pocket 94 is consistent. However, in other embodiments, the steepness of the angled-surface 116 may vary between container-retaining pockets 94. Although it is preferable that the container-retaining pockets have an angled surface, other embodiments will include container-retaining pockets designed to hold some or all of the containers in a straight vertical position.

Figure 11:
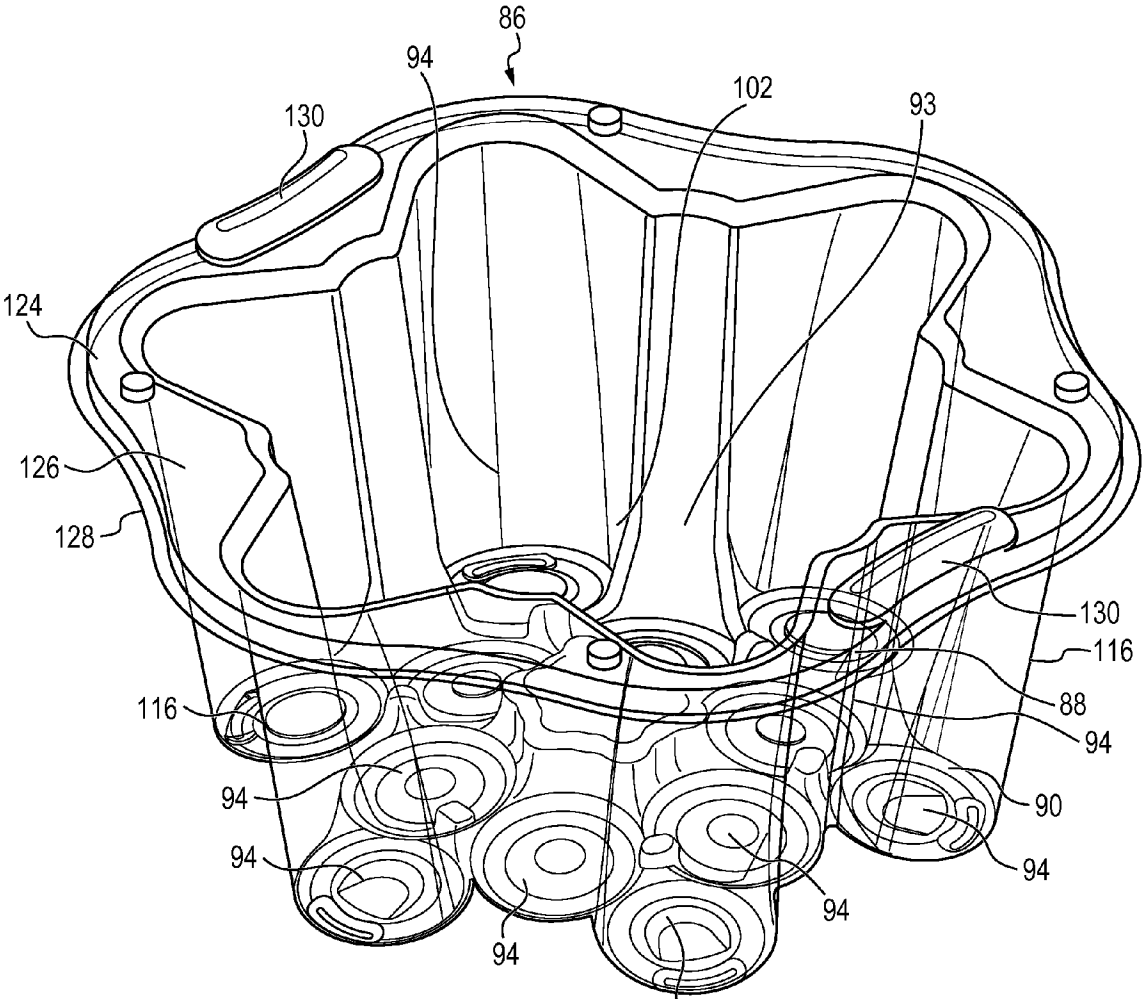
FIG. 11 is a perspective view of a base of the embodiment shown in FIG. 9.

FIG. 11 illustrates the base 86 of a device suitable for storing twelve containers and cooling component within the central cavity 93. The depiction of the base 86 of the device in FIG. 11 shows the container-retaining pockets 94 arranged in a generally circular configuration within the central cavity 93.

The floor of the base 86 between the circular configuration of container-retainer pockets 94 is somewhat raised in FIG. 11. However, the center-most area 102 of the central cavity 93 between the container-retaining pockets 94 is generally empty to allow space for the cooling component. As shown in FIG. 11, no barriers or dividers separate the container-retaining pockets 94 from one another or from the center-most area 102 of the central cavity 93 where the cooling component 114 may be stored. Thus, the cooling component 114 and the containers may come into direct contact with one another.

In the embodiment of the base 86 depicted in FIG. 11, the top portion of the base 86 features a flange 124 having a top surface 126 and a bottom surface 128. The top surface 126 of the flange 124 depicted in FIG. 11, includes two raised elongate areas 130 which protrude in an upward direction from the top surface 126 of the flange 124.

Figure 12:
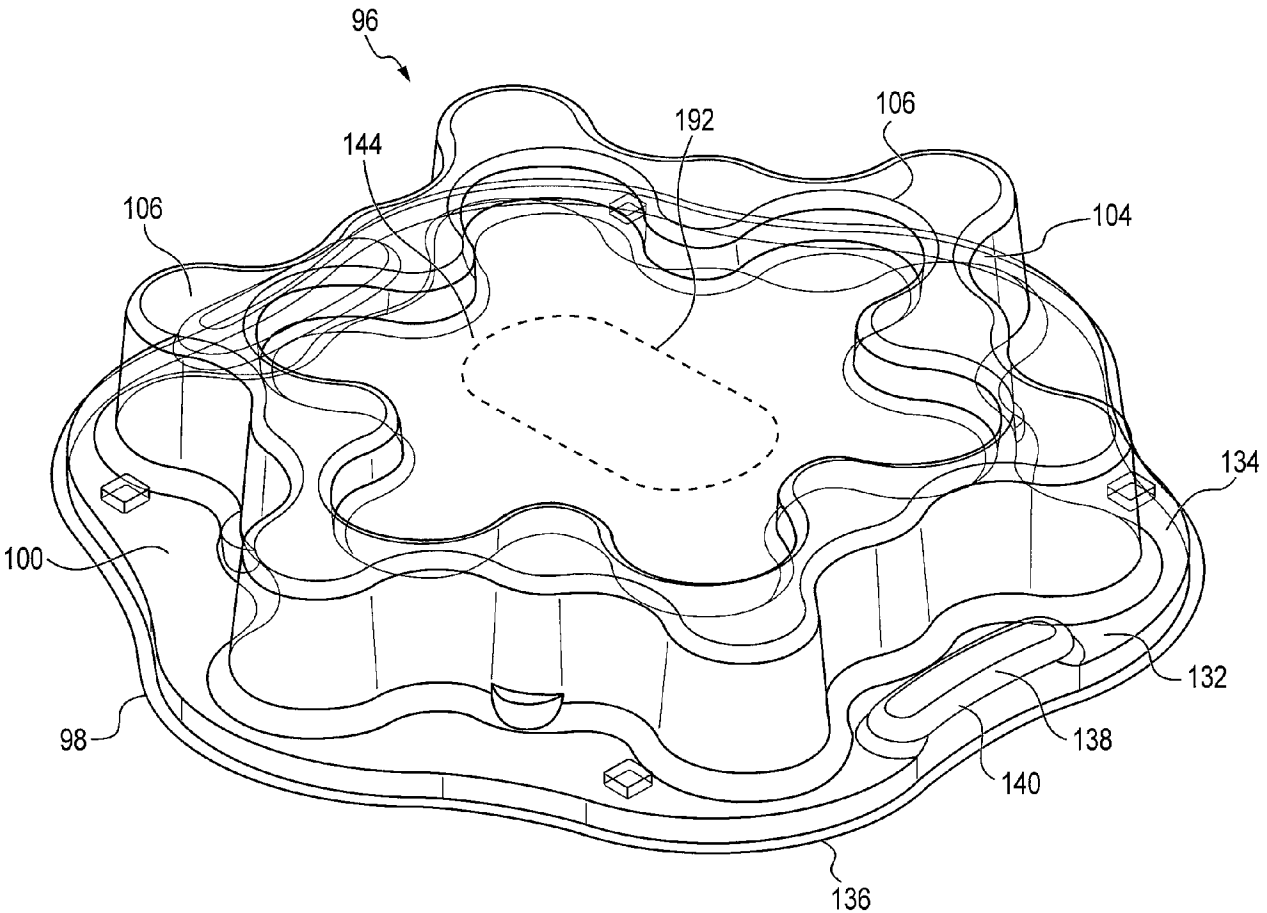
FIG. 12 is a perspective view of a lid of the embodiment shown in FIG. 9.

As shown in FIG. 12, the lid 96 of the device 84 may also include a flange 132 having a top surface 134 and a bottom surface 136. The raised elongate areas 130 on the top surface 126 of the flange 124 of the base shown in FIG. 11 preferably nest within a cavity 140 formed in the bottom surface 136 of the lid flange 132 created by the raised elongate area 138 formed on a lid flange 132. Together, the elongate areas 130, 138 on the base flange 124 of FIG. 11 and lid flange 132 of FIG. 12 form mating protrusions that may provide a pair of handles 142 for conveniently lifting the device 84 of FIG. 9.

Figure 13:
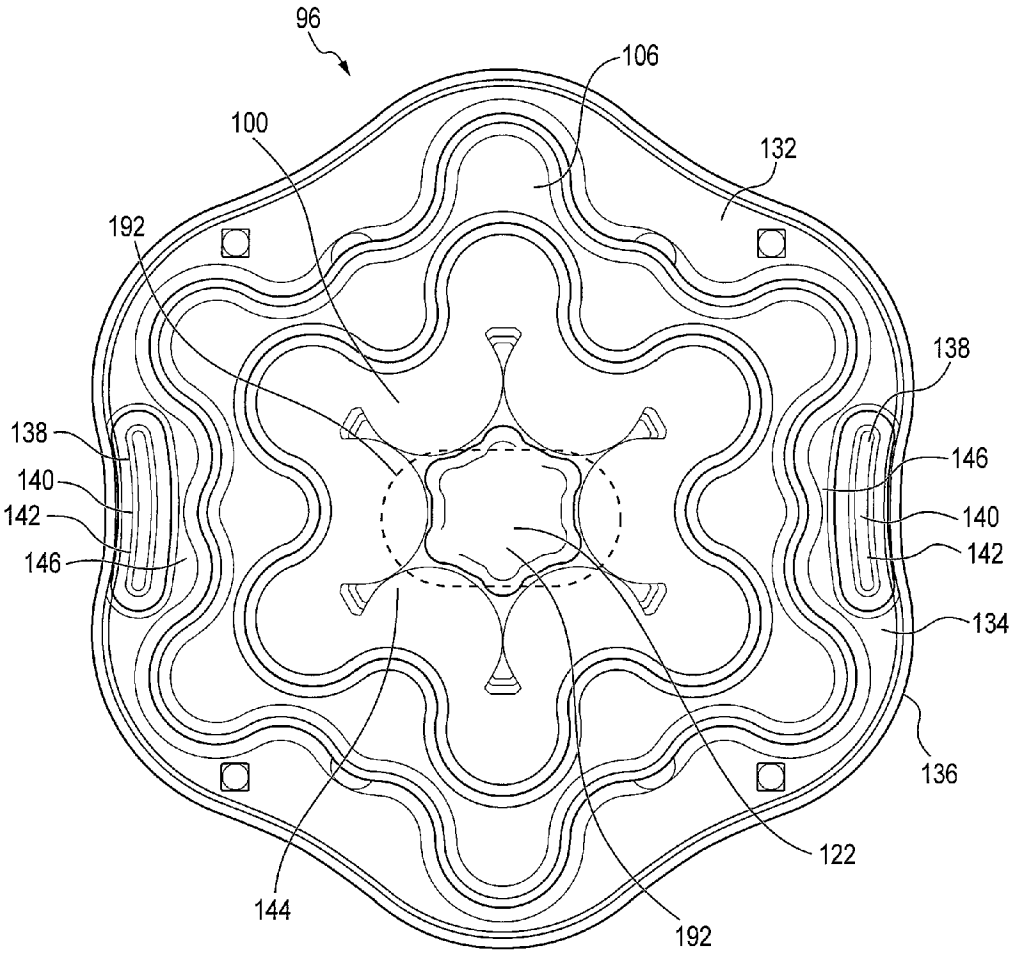
FIG. 13 is a top plan view of a lid of the embodiment shown in FIG. 9.

FIGS. 12 and 13 show the lid 96 of the device 84 depicted in FIG. 9. FIGS. 12 and 13 illustrate two views of the generally ring-like configuration 106 of the raised portion 104 of the lid 96. At the center of the ring-like configuration 106, the lid features a generally flat portion 144. As shown, the flat portion 144 may not only serve as a resting place for one or more containers 108 upon removal from the central cavity 93 of the device 84, but also may provide a convenient location for embossing, molding or writing brand information such as a logo 192.

Figure 14:
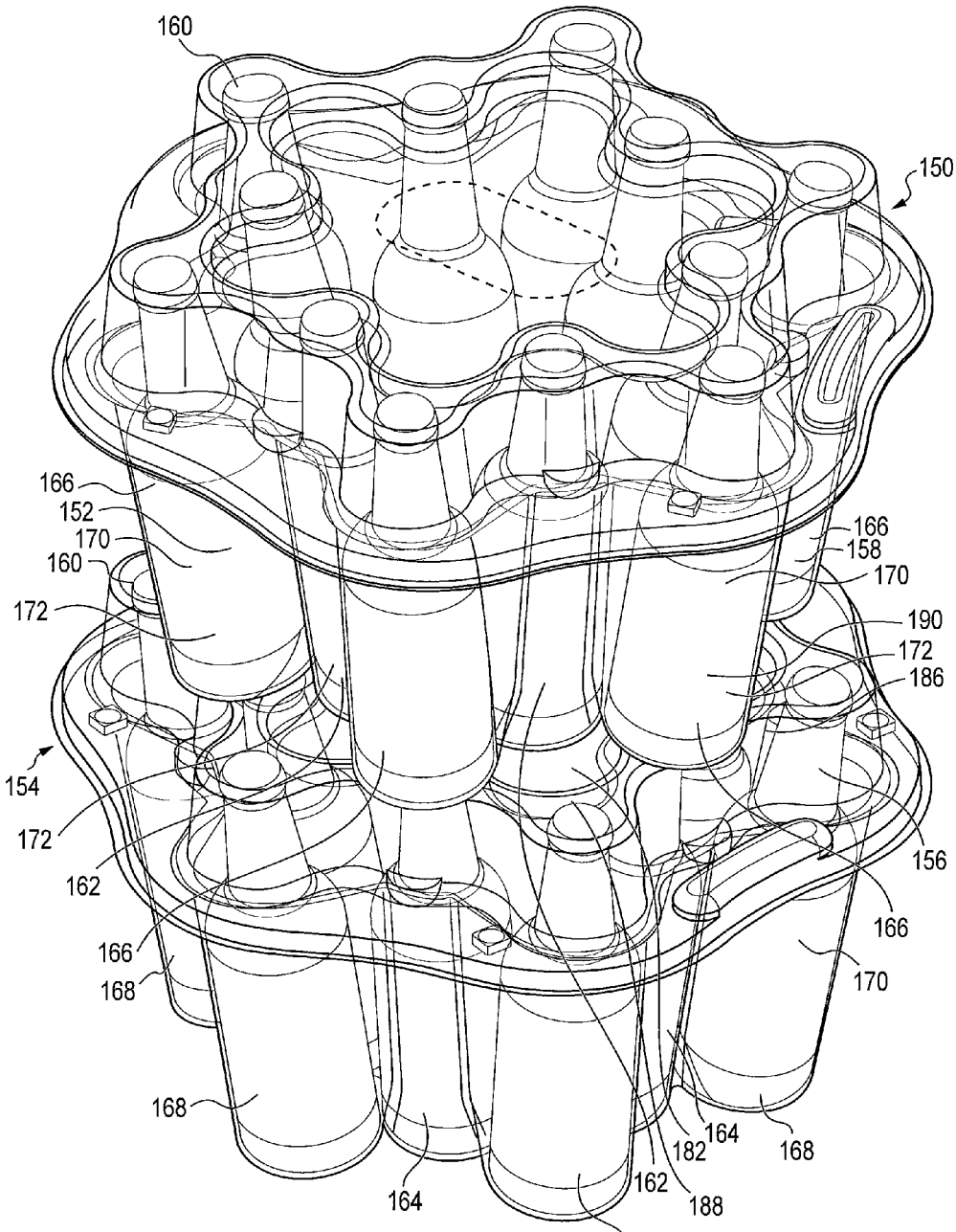
FIG. 14 is a perspective view of two of the embodiment shown in FIG. 9, stacked on top of one another.
Figure 15:
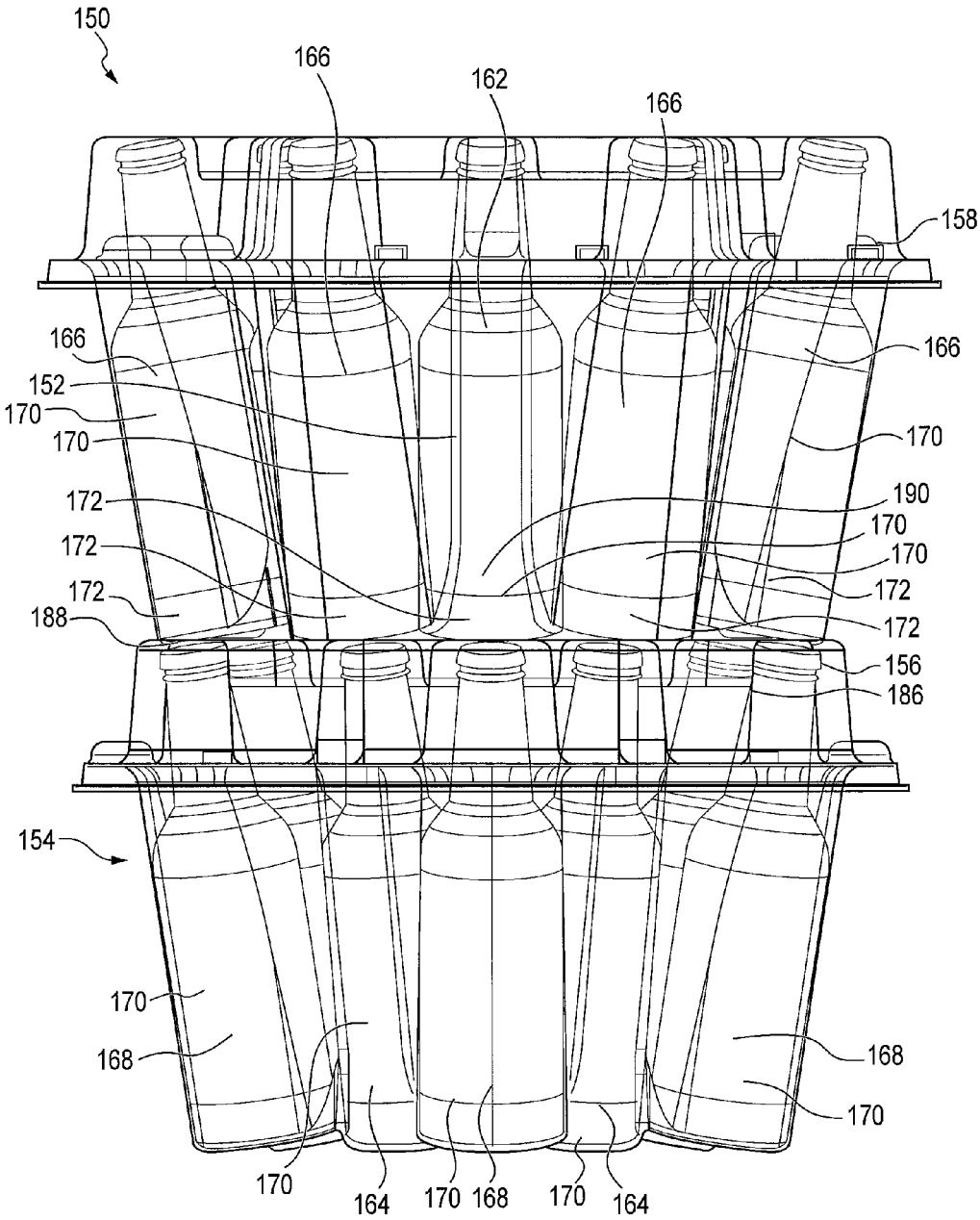
FIG. 15 is a side elevation view of two of the embodiment shown in FIG. 9, stacked on top of one another.

FIGS. 14 and 15 depict two of the devices shown in FIG. 9. In FIGS. 14 and 15, the base 152 of a top device 150 rests on the lid 156 of a bottom device 154. As shown in FIG. 14, each device is configured to hold twelve containers 158 in an undulating ring configuration 160 such that six containers are contained in an inner ring 162, 164 of container-retaining pockets 170 and six containers are contained in an outer ring 166, 168 of container-retaining pockets 170. When stacked, it is preferable that the bottom portion 190 of the base 152 of the top device 150 be aligned with the bottom device 154 such that the bottom of the inner ring 162 of container retaining pockets 170 of the top device rests immediately above the top of the outer ring 168 of container retaining pockets 170 on the bottom device. As best seen in FIG. 14, this alignment may allow the bottom portion 172 of each of the six container retaining pockets 170 of the inner ring 162 the top device 150 to nest within the cavity 182 formed by the ring-like raised portion 186 of the top surface 188 of the lid 156 of the bottom device 154. As seen in FIG. 14, the outer ring 166 of container retaining pockets 170 of the top device 150 may not be contained within the ring-like raised portion 186 of the top surface 188 of the lid 156. However, the two devices 150, 154 are kept from sliding by the nesting between the inner-ring 162 of container retaining pockets on bottom portion of the top device 150 and the ring-like raised portion 186 on the lid 156 of the bottom device 154. Multiple containers may be securely stacked vertically in this way.

The exemplary embodiments of the lid 18, 96 of the device shown in FIGS. 5 and 12 each have a raise portion with rounded and undulating curves. In other embodiments, it may be advantageous to have a non-undulating circular or ovular raised portion on the lid. In still other embodiments, the raised portion may feature sharp angles or may be molded to create a style consistent with a particular beverage company's trade dress or marketing campaign.

Figure 16:
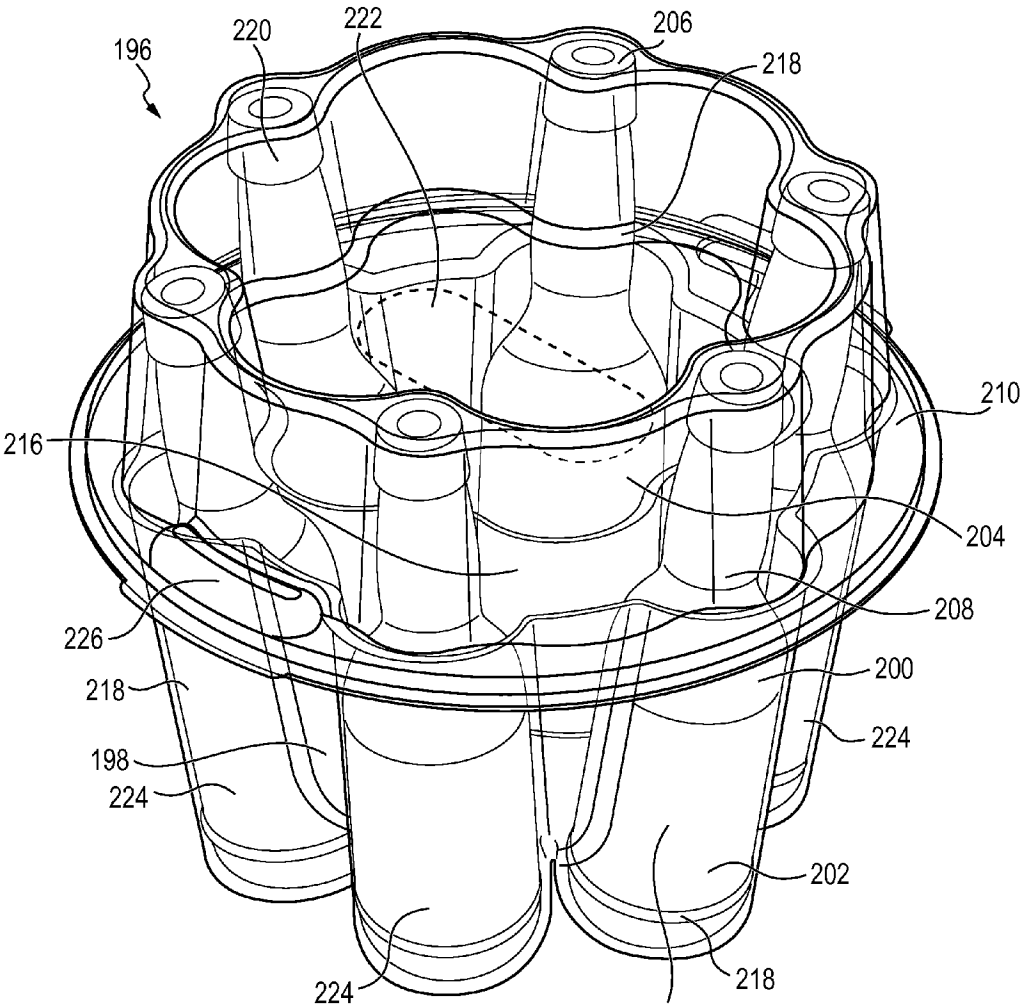
FIG. 16 is a perspective view of another embodiment of a device for storing six beverages, shown with beverage bottles.

FIG. 16 depicts another embodiment of a device configured to store generally cylindrical containers such as beverage containers. The device 196 includes a base 198 having a top portion 200 and a bottom portion 202. The base 198 includes a central cavity 216 configured to retain at least one container 218, such as a bottle or can, as well as cooling component, such as ice cubes or an ice pack. The base 198 of the embodiment shown in FIG. 16 also includes six container-retaining pockets 224 molded into the bottom portion 202 of the base 198.

The embodiment shown in FIG. 16 also includes a lid 204 having a top surface 206 and a bottom portion 208. As shown in FIG. 1, the lid 204 is configured to allow it to be conformingly and matingly attached to the top portion 200 of the base 198. The lid 204 shown in FIG. 16 includes a pocket 220 protruding from the lid 204, which is suitable for retaining the top portion of at least one container, such as a bottle or a can.

The embodiment depicted in FIG. 16 is configured to retain at least one container 218 such that the container 218 may come into direct contact with a cooling component located in the central cavity 216. The embodiment is also configured such that the bottom portion of each container 218 is capable of being retained in one of the container-retaining pockets 224 in the bottom portion 202 of the base 198 and the top portion of each container 218 is capable of being retained in the pocket 220 in the lid 204.

Figure 17A:
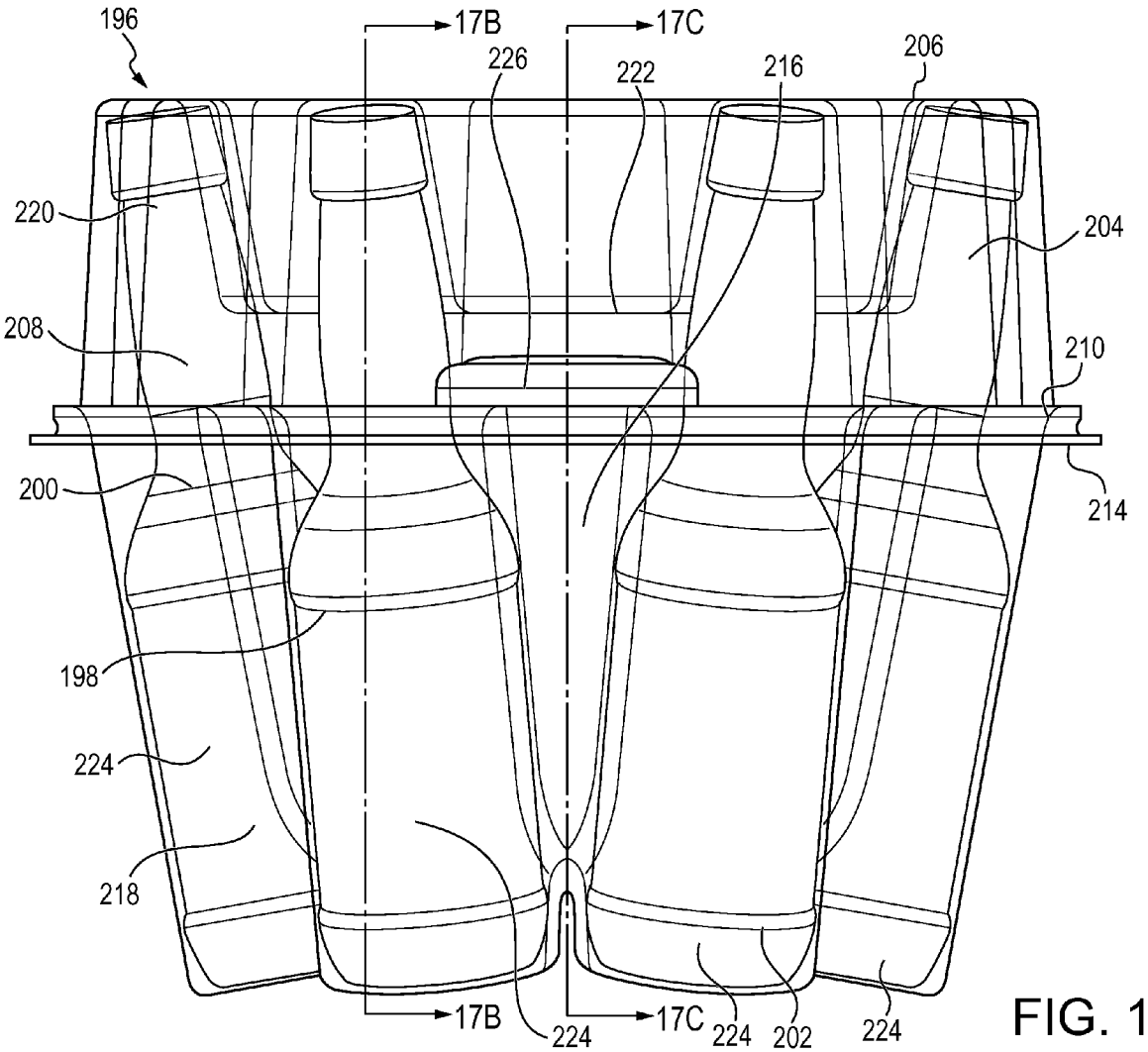
FIG. 17A is a side elevation view of the embodiment shown in FIG. 16.
Figure 17B:
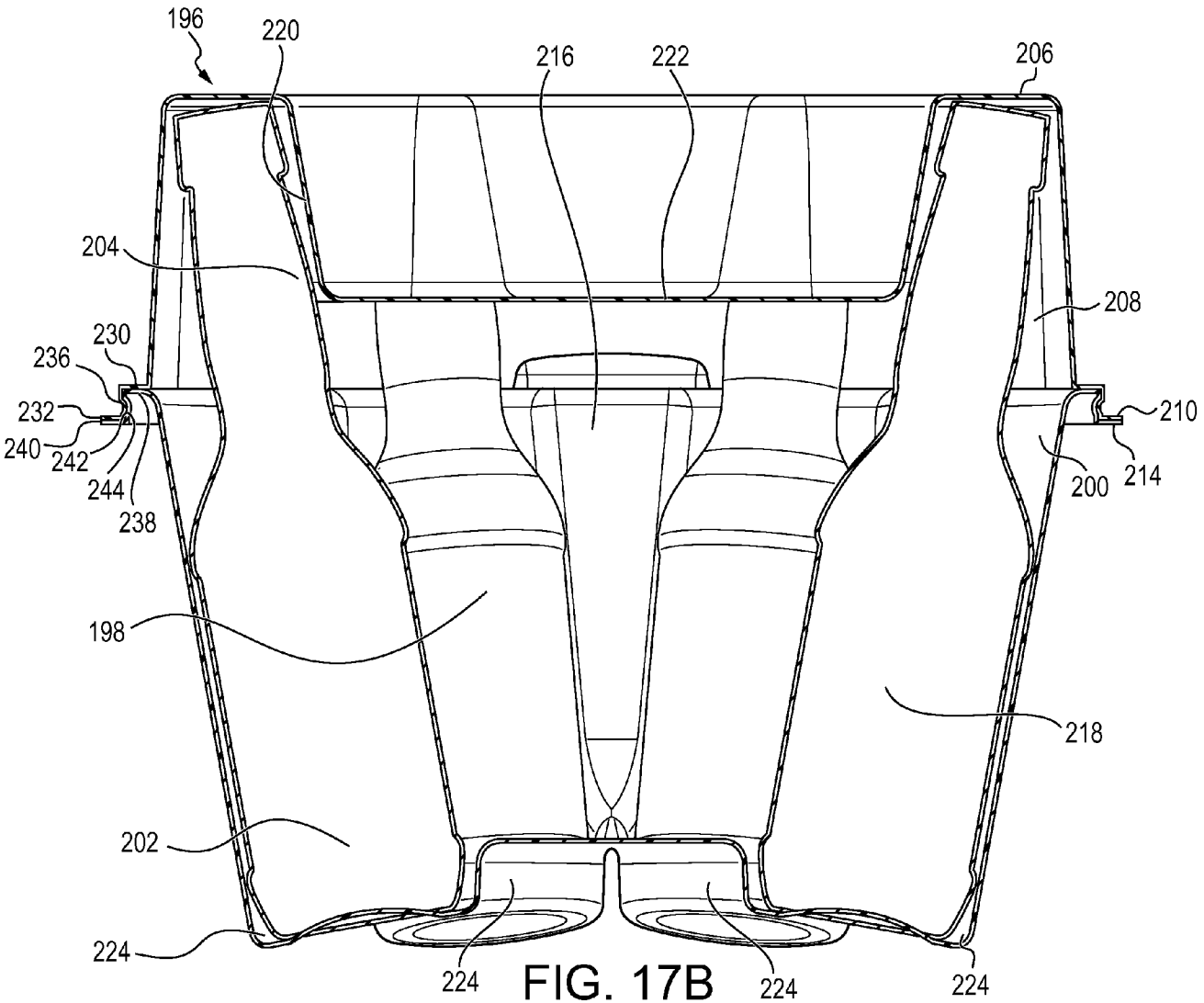
FIG. 17B is a cross-sectional view of the embodiment shown in FIG. 17A taken along line 17B-17B.
Figure 17C:
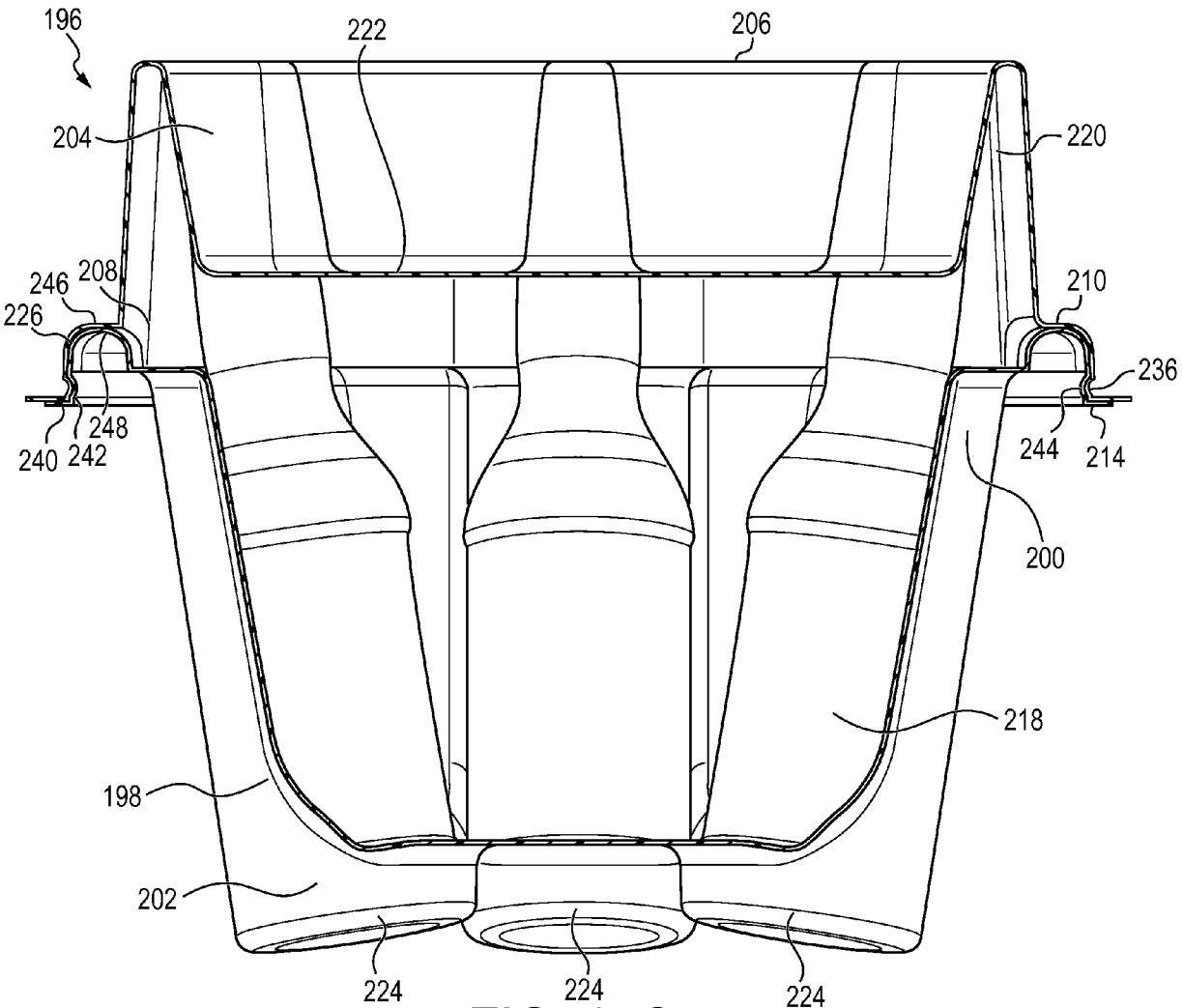
FIG. 17C is a cross-sectional view of the embodiment shown in FIG. 17A taken along line 17C-17C.

FIGS. 16 and 17 illustrate an embodiment of a mechanism for attaching the base 198 of the device 196 to the lid 204 of the device 196. As best shown in FIGS. 17A-C, the bottom portion 208 of the lid 204 may include a top flange 210. Conversely, the top portion 200 of the base 198 may include a bottom flange 214. As best seen in FIG. 17B, the top flange 210 may have an upper lip 230 and a lower lip 232 that are generally parallel with the flat portion 222 of the lid 204. Between the upper lip 230 and the lower lip 232, the top flange 210 runs generally perpendicular to the flat portion 222 of the lid 204 and may be undercut 236 as shown in FIG. 17B. The bottom flange 214 is shaped to include an upper lip 238, lower lip 240 and perpendicular portion 242 having an undercut 244, each of which are shaped to mate with the top flange 210. The mating undercuts 236, 244 on the top 210 and bottom flanges 214 serve to create a snap-fit closure between the base 198 and 204. This type of closure may be advantageous because it is reclosable. In addition, it may encircle the entire perimeter of the device 196, which may provide a better seal, potentially reducing spills as the cooling component within the central cavity 216 melts and better insulating beverages stored within the device 196.

Figure 18:
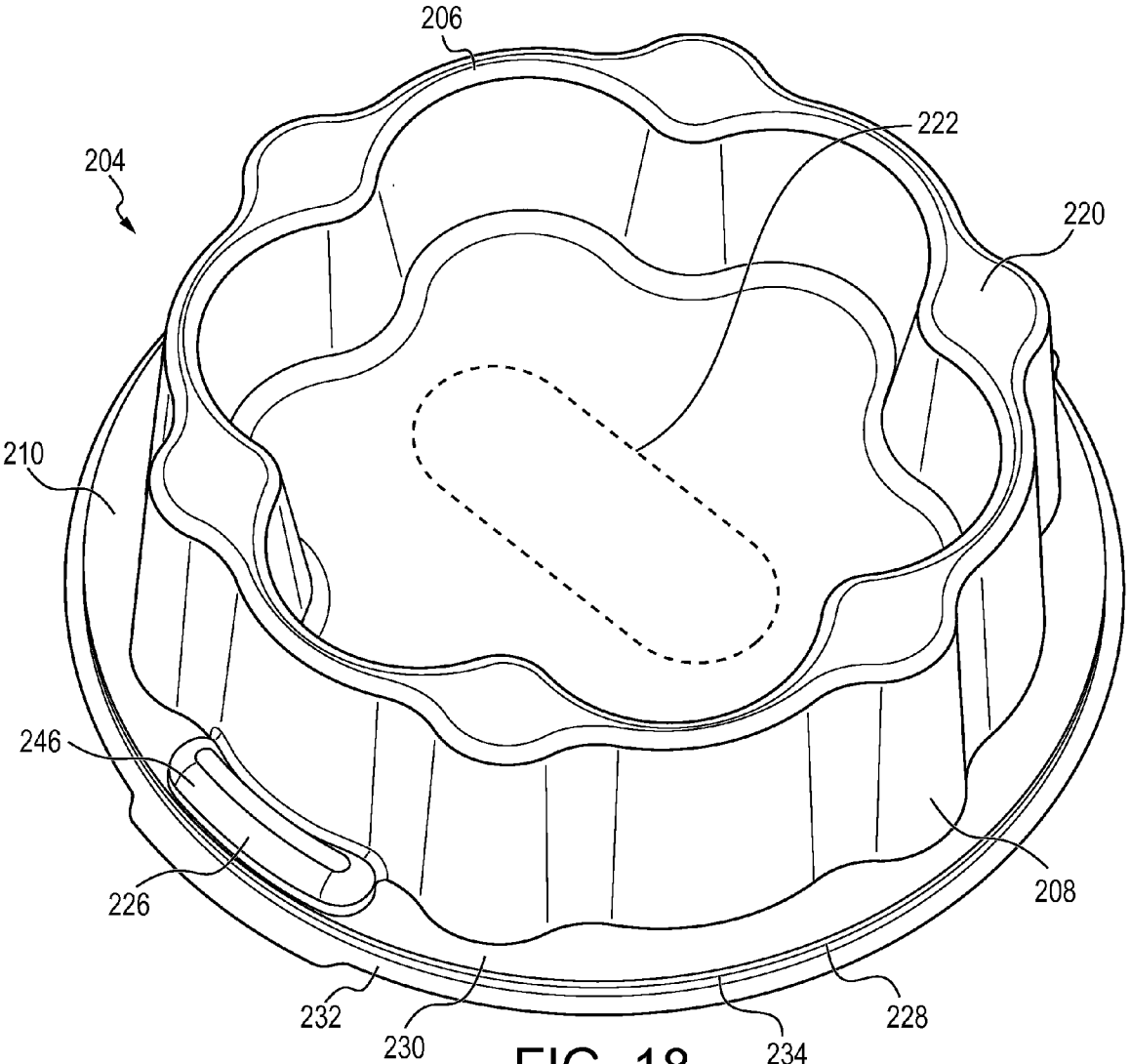
FIG. 18 is a perspective view of a lid of the embodiment shown in FIG. 16.

The top flange 210 and bottom flange 214 may also feature one or more handles 226. Unlike the handles 142 of the embodiment depicted in FIGS. 9-15 in which the handles 142 protrude from the flat portion of the flanges 124, 132 on the base 86 and lid 96, the handles 226 of the embodiment depicted in FIGS. 16-18 are molded into the side of the base 198 and lid 204. Thus, rather than having a flat portion forming an upper lip at the point along the perimeter of the device at which a handle is located, the top flange 210 in FIG. 17C is raised to form the female portion 246 of the handle 226. Similarly, rather than having a flat portion that forms an upper lip at the point along the perimeter of the device at which a handle is located, the bottom flange 214 in FIG. 17C protrudes upwardly to form the male portion 248 of the handle 226. In contrast to the handles 226 shown in FIG. 17C, in devices like those depicted in FIGS. 9-15 having a handle 142 formed by a protrusion in the flat portion of the flanges 124, 132, the area of the flanges 146 between the handle 142 and the device 84 may comprise a weak point that is susceptible to bending when the device 84 is lifted by the handles 142. Thus, having handles that merge with the base 198 and lid 204 as shown in FIG. 17C may be advantageous because it eliminates this potential weak area. This type of handle may be particularly advantageous for embodiments designed to carry large-sized beverages such as 24 ounce cans or wine bottles.

The device may be modified to accommodate a wide variety of containers. For example, the device 196 depicted in FIGS. 16-19 is configured to accommodate long-stemmed bottles. The long-stemmed bottle design allows the device 196 to feature a deep recess between the top of the pocket 220 on the lid 204 and the flat portion 222 of the lid 204. In this exemplary embodiment, the height of a single device 196 from the top of the pocket 220 on the lid 204 to the bottom 202 of the base 198 may be approximately 9.9 inches and the height of the lid 204 may be approximately 3.8 inches. When two identical devices 196 are stacked together, due to the deep recess in the lid 204, the two devices may have a cumulative height of approximately 17.5 inches.

Figure 19:
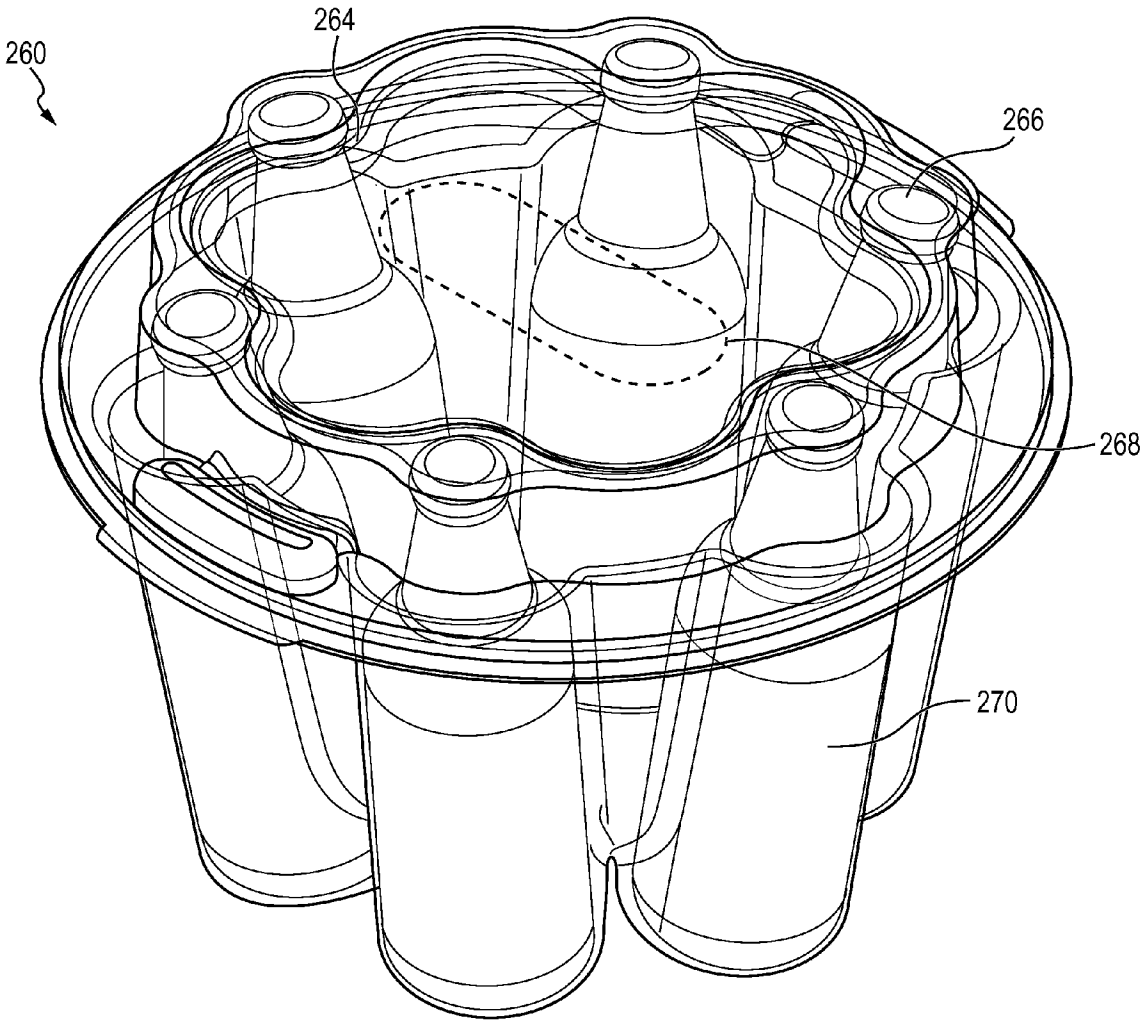
FIG. 19 is a perspective view of another embodiment of a device for storing six beverages, shown with shorter beverage bottles than the above-described embodiments.

FIG. 19 illustrates another embodiment of the device 260 that is designed to accommodate short-stemmed beverage bottles. In this embodiment, the lid 264 may have a shallow recess between the top of the pocket 266 on the lid and the flat portion 268 of the lid 264. In this exemplary embodiment, the height of a single device 260 from the top of the pocket on the lid to the bottom of the base may be approximately 8 inches and the height of the lid may be approximately 1.9 inches. When two identical devices are stacked together, due to the shallow recess in the lid, the two devices may have a height of approximately 14.6 inches.

Figure 20:
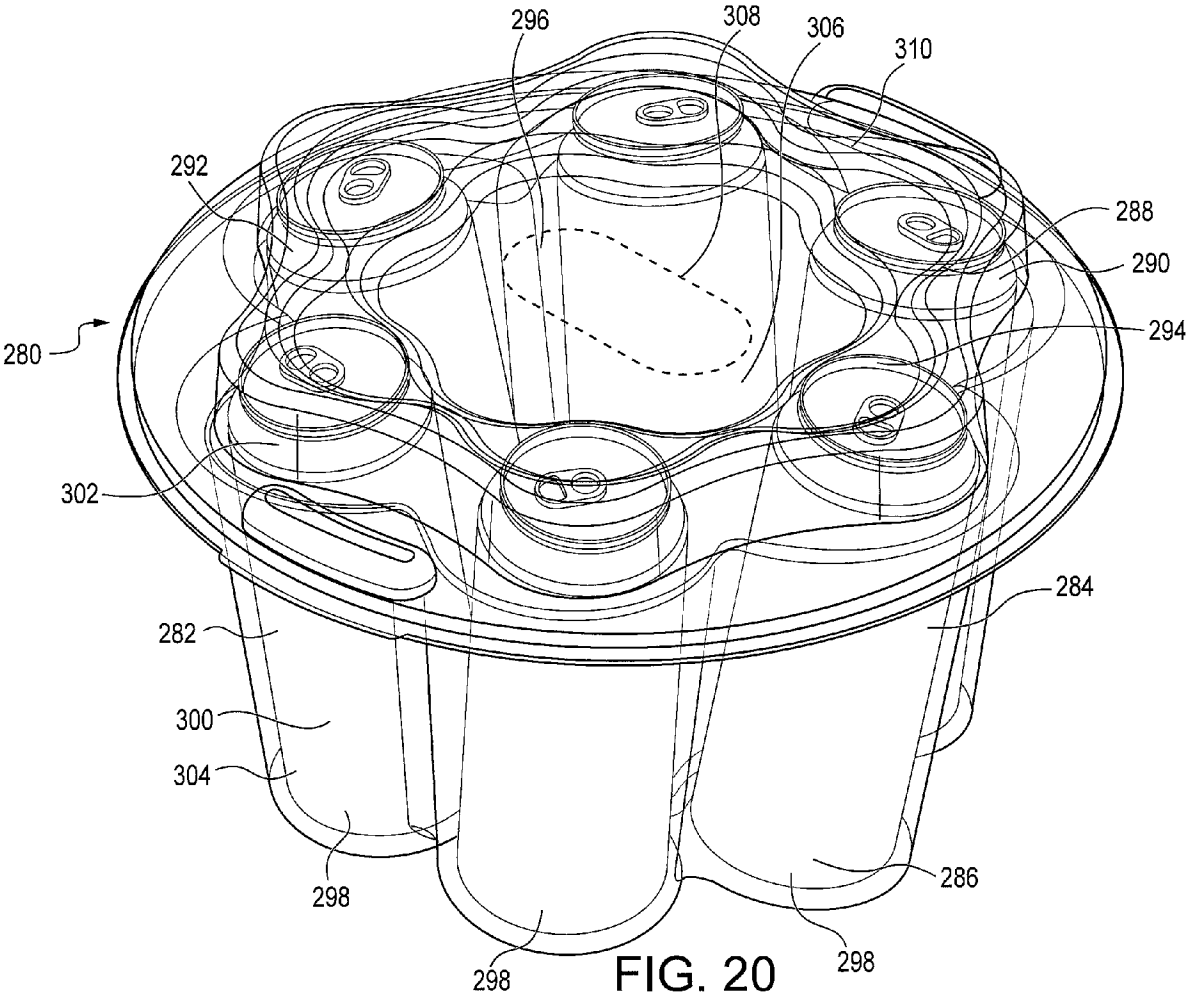
FIG. 20 is a perspective view of another embodiment of a device for storing six beverages, shown with beverage cans.
Figure 21:
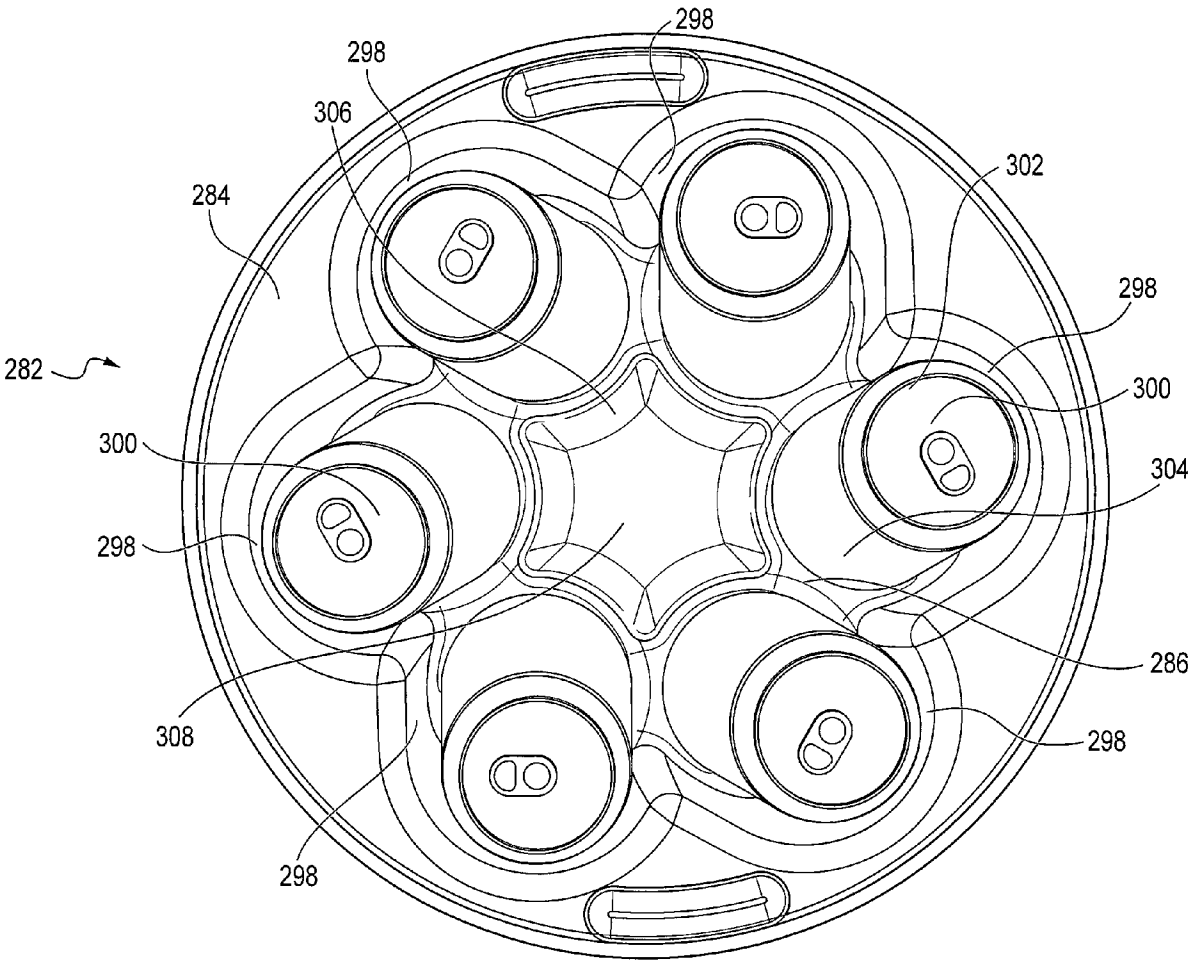
FIG. 21 is a top plan view of a base of the embodiment shown in FIG. 20.
Figure 22:
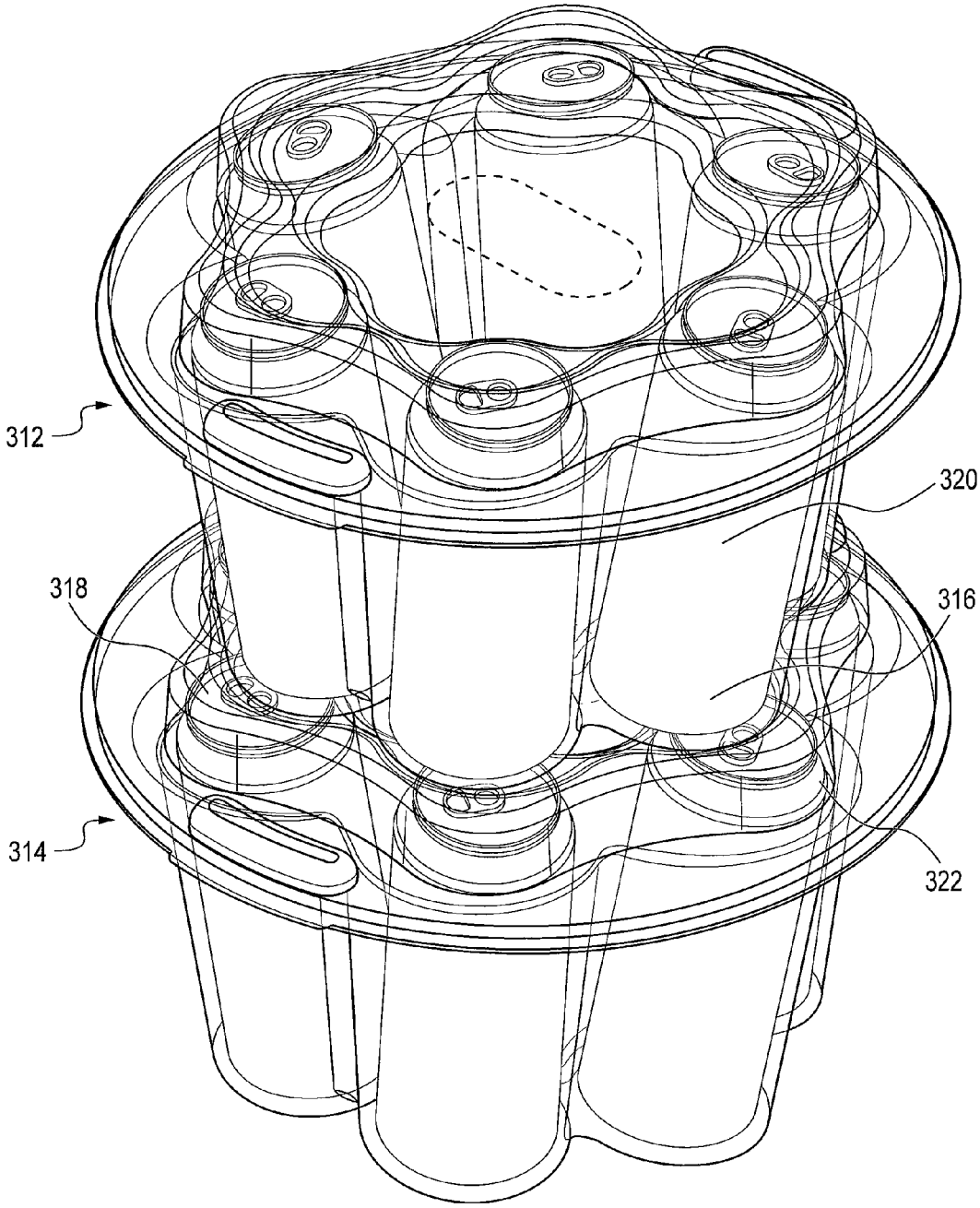
FIG. 22 is a perspective view of two of the embodiment shown in FIG. 20, stacked on top of one another.

FIGS. 20-22 illustrate a device 280 designed to accommodate six 24-ounce cans. As shown in FIG. 20, the device includes a base 282 having a top portion 284 and a bottom portion 286. The base 282 includes six container-retaining pockets 298 which are designed to accommodate six containers 300. The device 280 further includes a lid 288 from which a pocket 290 protrudes. The pocket 290 in the lid 288 is configured to contain the tops of six containers 300 resting in the container-retaining pockets 298 of the base 282. In the embodiment shown in FIGS. 20-22, the pocket 290 on the lid 288 includes a top ridge 292 and a middle ridge 294 between the top ridge 292 and the generally flat portion 296 of the lid 288.

The top ridge 292 of the lid 288 shown in FIG. 20 forms a ring-like structure 310 that is sized to contain the bottom portion 286 of the base 282 of the device 280. The middle ridge 294 on the lid 288 depicted in FIG. 20 is sized to provide a surface on which the bottom portion 286 of the base 282 of the device 280 may rest. Thus, when two devices 312, 314 are stacked on top of one another as shown in FIG. 22, the base 320 of the top device 312 rests on top of the middle ridge 294 and fits securely within the ring-like structure 318 on the lid 322 of the bottom device 314. This configuration serves to reduce the risk of tipping or slipping of the top device 312 when the devices are stacked.

The container-retaining pockets 298 of the embodiment of the device 280 depicted in FIGS. 20-22 are specially configured to reduce the risk of tipping. As best seen in FIG. 20, the container-retaining pockets 298 are configured at an angle such that the top 302 of each container 300 is further from the centermost point 308 of the device 280 than the bottom 304 of each container 300. As discussed, this configuration allows for the devices to be molded such that the lids and bases nest with one another when multiple devices are stacked to prevent tipping. However, when a single device is in use and all but one or two of the container-retaining pockets 298 are in use, this angling may make the device 280 susceptible to tipping. In order to reduce the risk of tipping, the container retaining pockets 298 are preferably structured so that the top of each container-retaining pocket 298 leans toward one side in addition to leaning outward. This is best seen in FIG. 21 where the angling of the container-retaining pockets 298 to the side gives the configuration of the containers 300 a swirled appearance. FIG. 21 illustrates the containers 300 leaning in a counter-clockwise direction. In other embodiments the devices may lean in a clockwise direction or may not lean at all. The use of angling in a clockwise or counter-clockwise direction may be especially advantageous for embodiments of the device designed to hold large-size beverages such as 24-ounce cans or wine bottles.

The embodiment depicted in FIGS. 20-22 features a shallow recess between the top of the pocket 290 on the lid 288 and the flat portion 296 of the lid 288. In this exemplary embodiment, the height of a single device 280 from the top of the pocket 290 of the lid 288 to the bottom 286 of the base 282 may be approximately 8.3 inches and the height of the lid 288 may be approximately 1.8 inches. When two identical devices 312, 314 are stacked together as illustrated in FIG. 22, due to the shallow recess in the lid, the two devices may have a height of approximately 16.4 inches.

The measurements discussed in relation to FIGS. 16-22 above are exemplary only. The height of the devices and the depth of the recess in the lid may vary depending on the size and shape of the containers desired to be stored within. For example, the device may be modified to accommodate 12-ounce cans or bottles, 16-ounce cans or bottles, 24-ounce cans or wine bottles. Further, it may be advantageous to design the base of the device such that a variety of different sized lids may fit on the base. Thus, a single base may be adapted to accommodate a variety of different-sized containers.

Figure 23:
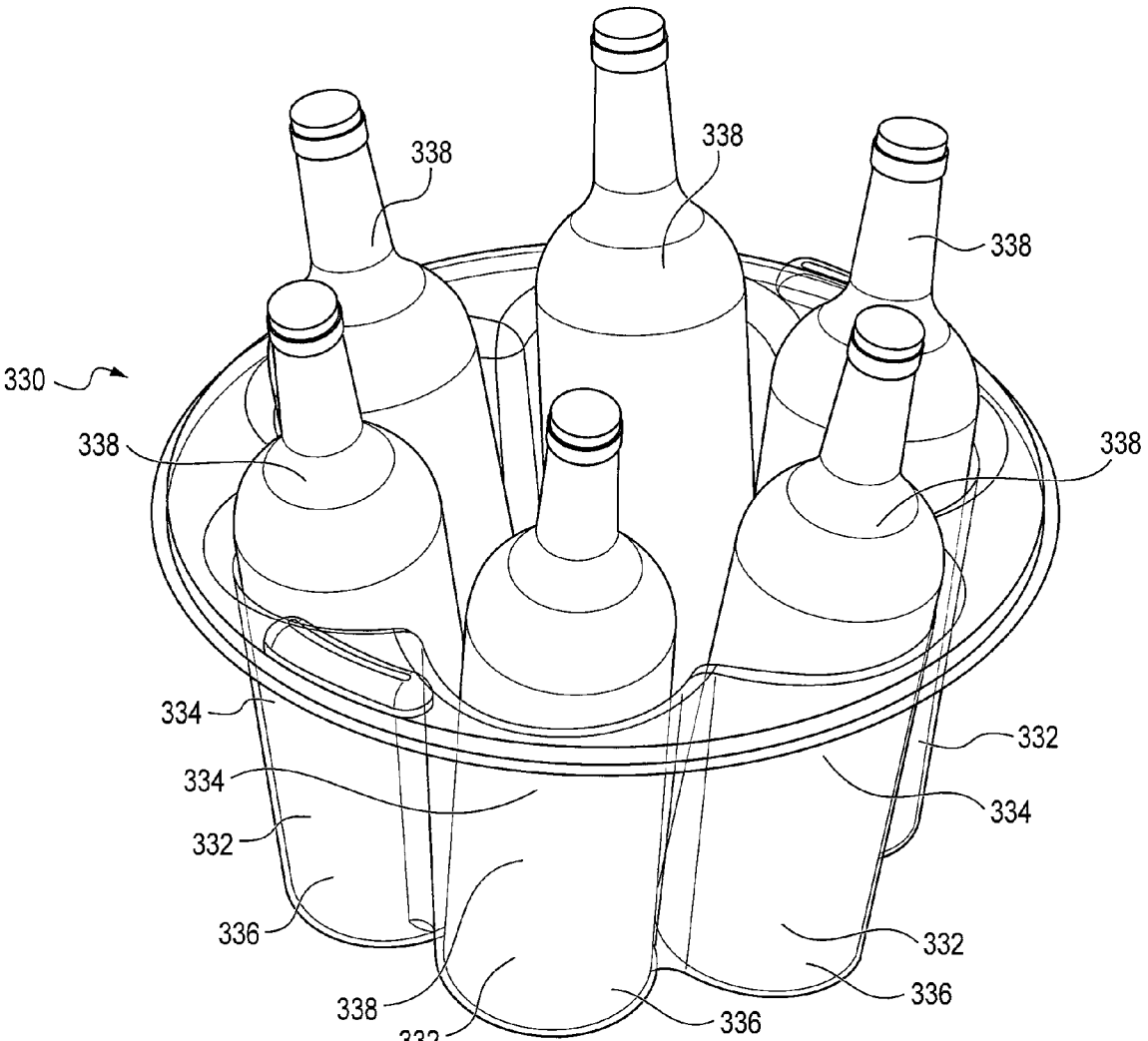
FIG. 23 is a perspective view of a base of another embodiment of a device for storing six beverages, shown with taller beverage bottles such as, for example, wine bottles.
Figure 24:
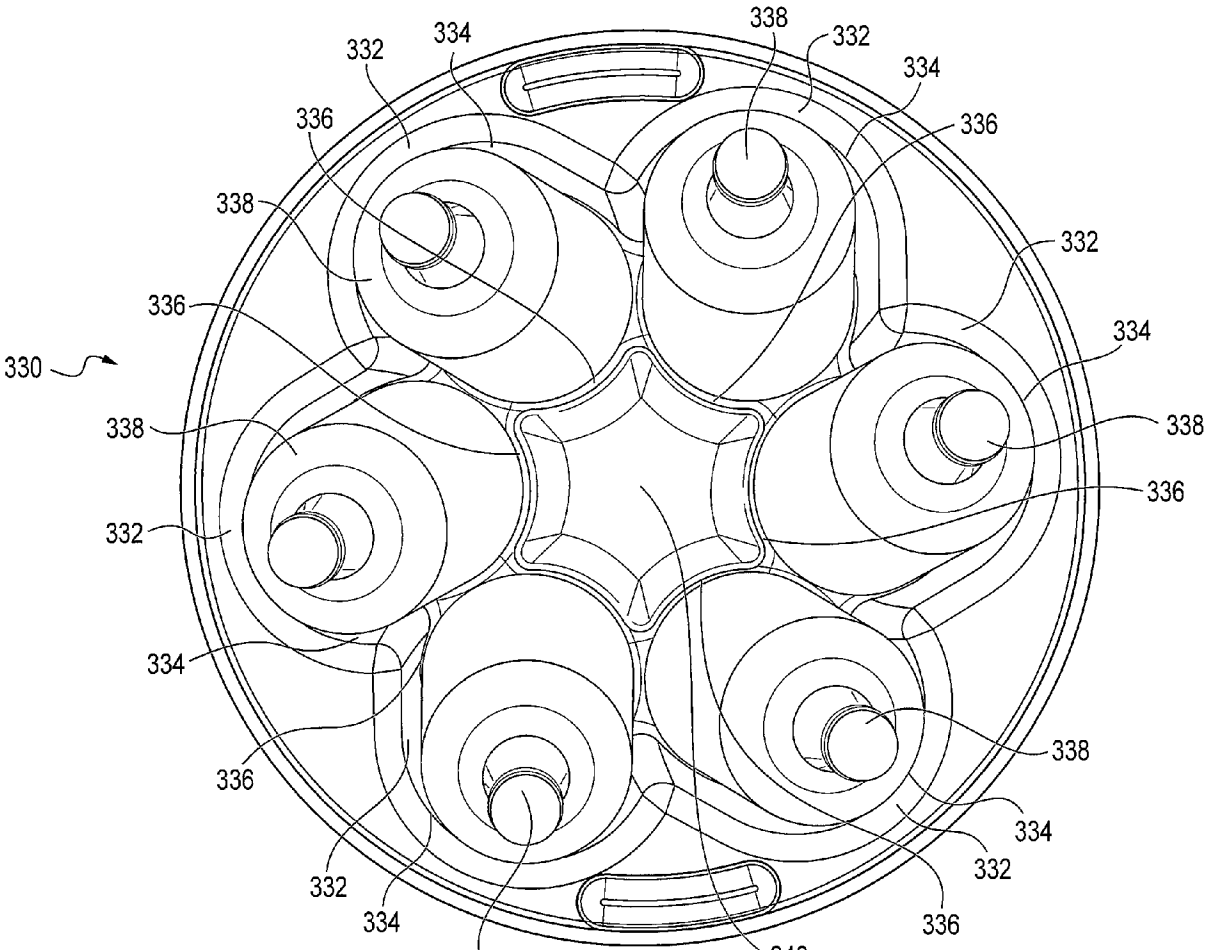
FIG. 24 is a top plan view of the base of the embodiment shown in FIG. 23.

FIGS. 23 and 24 illustrate another embodiment of a base 330 of the device, which is designed to hold large-sized containers 338 such as wine bottles. The embodiment of the base 330 shown in FIGS. 23 and 24 includes six container-retaining pockets 332, each having a top portion 334 and a bottom portion 336. For each container-retaining pocket 332, the pocket 332 is angled outwardly and in a counter-clockwise direction from the bottom 336 of the pocket 332 toward the top 334. Thus, the top 334 of each container-retaining pocket 332 is positioned further from the center 340 of the base 330 than the bottom 336 of each container-retaining pocket 332. Further, the top 334 of each container-retaining pocket 332 is displaced in a counter-clockwise direction relative to the bottom 336 of each container retaining pocket 332.

While the embodiments of the device illustrated in FIGS. 9-22 feature a pair of handles 142, 226 formed by mating protrusions on the flanges of the base and lid of the devices, handles may vary in other embodiments. For example, in some embodiments, handles may be formed on a flange on the base of the device alone with no nesting area on a top flange. Handles may be also formed by apertures formed in a flange of a base and/or lid rather than by nesting protrusions. In some embodiments apertures may be coupled with a rope, plastic grip or other component to form a handle. Some embodiments may be structured such that an injection molded handle may snap onto the device. In still other embodiments, mating protrusions may be sized and shaped to form a snap fit seal between the base and lid of the device to recloseably seal the base and lid together. Handles may also be formed by any other method known in the art.

The number of handles may also vary. In some embodiments it may be preferable to have no handle (e.g., FIGS. 1-8) or only one handle. By contrast, in other embodiments, there may be two, three, four, five, six or more handles. In embodiments having numerous handles along the entire periphery of the lid and/or base, it may be preferable to structure the handles such that they form a snap-fit seal between the lid and base of the device.

The exemplary embodiments of the device configured to store generally cylindrical containers depicted in FIGS. 1, 9, 16, 19, 20 and 23 each include a flange encircling the lid and/or base of the devices. While such flanges may be advantageous to allow for space for reclosable sealing mechanisms, non-reclosable sealing mechanisms, or handles, other embodiments of the device may lack such flanges. Other embodiments may have a flange on only the base or only the lid. Still other embodiments may have flanges on both the lid and base which do not align perfectly with one another when the lid and base are pressed together.

The exemplary embodiments shown in FIGS. 1, 9, 16, 19, 20 and 23 each have a generally circular or hexagonal configuration. Depending on the number of container-retaining pockets and their configuration, other embodiments may have a generally square, triangular, rectangular, ovular, pentagonal, heptagonal or any other polygon-shaped configuration. In particular, it may be desirable for other embodiments to have a generally rectangular configuration. In such embodiments, the container retaining pockets may be configured in a generally rectangular shape rather than a generally circular shape. Accordingly, the pocket(s) on the lid of such embodiments may have a generally rectangular configuration rather than a circular or ring-like configuration. Embodiments having a generally rectangular configuration may be advantageous because they may maximize shipping and storage space.

The base of the devices depicted in FIGS. 1, 9, 16, 19, 20 and 23 are preferably integrally formed of a single piece of material. This is advantageous because the lack of seams or joints may prevent leaking, assist in temperature control, and reduce the risk of breakage by eliminating weak points. Similarly, the lids of the devices depicted in FIGS. 1, 9, 16, 19, and 20 are preferably integrally formed of a single piece of material. While an integrally formed base and integrally formed lid may be advantageous, embodiments of the device may have a base and/or lid formed of more than one piece of material.

The device for storing beverages is preferably formed via thermoforming using a suitable thermoplastic material. It is especially preferable that the device be composed of a recyclable thermoplastic material. Suitable materials for the device may include APET, PPG, RPET, PLA, PVC, PET, HDPe, polypropylene or other bioplastics. However, any other plastic or other suitable material known in the art may be utilized. Further, the lid and base may each be composed of the same type of material or different materials.

It may be advantageous to make all or part of the device for storing beverages of a clear or translucent material to allow purchasers or users to view the beverages within the container. Color-tinted translucent materials may be particularly advantageous because certain colors may assist in conveying brand information or catching a prospective purchaser's interest.

In addition to cooling beverages, the device for storing beverages is particularly well-suited for promotional marketing of beverage products. Because of the device's relatively inexpensive construction and potential for recycling, it may replace paper or card-board product packaging without significantly increasing price. In fact, because the devices may be securely stacked directly on top of one another via nesting lid and base components, they may actually reduce packaging and display costs by eliminating the need for expensive shelving or promotional display structures. For this reason, embodiments of the device having a nesting lid and base may be particularly well-suited for seasonal product displays in grocery stores or other retail locations. In addition, the potential use of the device as a cooler may attract consumers to beverages packaged in the device over other, comparable beverages.

The device for containing beverages also has advantages for consumers. The device is both reusable and disposable, making it ideal for consumers who may wish to purchase a cooler for short-term use. For example, consumers planning a long weekend of outdoor activities such as picnicking, tailgating, boating or camping may desire an inexpensive cooler in which they can store a modest number of beverages for individual outings and that they can discard after the weekend. Because embodiments of the device may be both reusable and recyclable, they are ideally suited for this type of use. The device may also be particularly well-suited for use at beaches, concerts, or other outdoor activities.

While preferred embodiments of the invention have been described, it should be understood that the invention is not so limited, and modifications may be made without departing from the invention. The scope of the invention is defined by the appended claims, and all devices that come within the meaning of the claims, either literally or by equivalence, are intended to be embraced therein. Furthermore, the advantages described above are not necessarily the only advantages of the invention, and it is not necessarily expected that all of the described advantages will be achieved with every embodiment of the invention.

I claim:

1. A device configured for storing generally cylindrical containers, comprising:

a base having a top portion and a bottom portion, and a central cavity configured to retain at least one container and a cooling component;

at least three container-retaining pockets molded into the bottom portion of the base, each container-retaining pocket being configured to retain a container having a top portion and a bottom portion at an angle such that the bottom portion of each container is located closer to a center of the device than the top portion;

a lid having a top surface and a bottom surface, the lid being configured to conformingly and matingly fit to the top portion of the base;

at least three pockets protruding from the lid, each of the at least three pockets being shaped to retain a top portion of a container, wherein the device is configured to retain at least three containers such that the containers will contact a cooling component located in the central cavity.

2. The device according to claim 1, wherein the base is integrally formed.

3. The device according to claim 1, wherein the device is composed of transparent or translucent thermoplastic.

4. The device according to claim 1, wherein the device includes six container-retaining pockets arranged in a generally circular configuration.

5. The device according to claim 4, wherein the device is configured to contain glass bottles.

6. The device according to claim 4, wherein the device is configured to retain cans.

7. The device according to claim 1, wherein the device includes twelve container-retaining pockets arranged in a generally circular configuration.

8. The device according to claim 1, wherein each of the container-retaining pockets is structured to retain a container in an angled position such that the top portion of the container is tilted to one side relative to the bottom portion of the container.

9. The device according to claim 1 further comprising:

a bottom flange protruding from the top portion of the base;

a top flange protruding from a bottom portion of the lid; and at least one attaching means capable of attaching the bottom flange and the top flange.

10. The device according to claim 1 further comprising:

a generally flat portion on the top of the lid, wherein the generally flat portion is configured to serve as a resting place for at least one container upon removal from the central cavity of the device.

11. A device configured for storing generally cylindrical containers, comprising:

a base having a top portion and a bottom portion, and a central cavity configured to retain at least one container and a cooling component;

at least three container-retaining pockets molded into the bottom portion of the base;

a lid having a top surface and a bottom surface, the lid being configured to conformingly and matingly fit to the top portion of the base;

at least three pockets protruding from the lid, each of the at least three pockets being shaped to retain a top portion of a container;

a bottom flange protruding from the top portion of the base;

a top flange protruding from a bottom portion of the lid; and at least one attaching means capable of attaching the bottom flange and the top flange, the attaching means including a first undercut located on the bottom flange, a second undercut located on the top flange, and wherein the first undercut is configured to matingly fit with the second undercut to form a reclosable seal, wherein the device is configured to retain at least three containers such that the containers will contact a cooling component located in the central cavity.

12. A device configured for storing generally cylindrical containers, comprising:

a base having a top portion and a bottom portion, and a central cavity configured to retain at least one container and a cooling component;

at least three container-retaining pockets molded into the bottom portion of the base;

a lid having a top surface and a bottom surface, the lid being configured to conformingly and matingly fit to the top portion of the base;

at least three pockets protruding from the lid, each of the at least three pockets being shaped to retain a top portion of a container;

a bottom flange protruding from the top portion of the base;

a top flange protruding from a bottom portion of the lid; and at least one attaching means capable of attaching the bottom flange and the top flange, at least one raised elongate area formed in the bottom flange; and at least one raised elongate area formed in the top flange, wherein the raised elongate areas on the bottom flange and top flange may be aligned when the device is in a closed position such that the elongate areas on the flanges together form at least one handle, wherein the device is configured to retain at least three containers such that the containers will contact a cooling component located in the central cavity.

13. The device according to claim 12, wherein the at least one raised elongate area formed in the bottom flange merges with a side of the lid and the at least one raised elongate area formed in the top flange merges with a side of the base.

14. A device configured for storing generally cylindrical containers comprising:

a base having a top portion and a bottom portion, and a central cavity configured to retain at least one container and a cooling component;

at least three container-retaining pockets molded into the bottom portion of the base;

a lid having a top surface and a bottom surface, the lid being configured to conformingly and matingly fit to the top portion of the base; and at least three pockets protruding from the lid, each of the at least three pockets being shaped to retain a top portion of a container, wherein the device is configured to retain at least three containers such that the containers will contact a cooling component located in the central cavity, wherein the top of the lid is molded to fit the bottom portion of the base such that the bottom portion of the base is configured to rest between the pockets protruding from the lid when the base is stacked on top of the lid.

15. A device configured for storing generally cylindrical containers comprising:

a base having a top portion and a bottom portion, and a central cavity configured to retain at least one container and a cooling component;

at least three container-retaining pockets molded into the bottom portion of the base;

a lid having a top surface and a bottom surface, the lid being configured to conformingly and matingly fit to the top portion of the base; and at least three pockets protruding from the lid, each of the at least three pockets being shaped to retain a top portion of a container, wherein the device is configured to retain at least three containers such that the containers will contact a cooling component located in the central cavity, wherein the at least three pockets are connected together to form a single ring-like protrusion on the lid.

16. A device capable of storing beverages, comprising:

a base having a top portion and a bottom portion, the bottom portion forming a cavity;

a plurality of container-retaining pockets molded into the bottom portion of the base, each container-retaining pocket being configured to retain a bottom portion of a container;

a centermost portion of the cavity formed by the bottom portion of the base, the centermost portion being positioned at a center of the container-retaining pockets;

a lid having a top surface and a bottom surface, the lid being configured such that it may be attached to the top portion of the base; and a raised portion protruding from the top surface of the lid having a ring-like configuration, wherein the device is configured to securely retain a plurality of containers such that the bottom portion of each container rests in a container-retaining pocket in the base and the top portion of each container rests in the raised portion of the top surface of the lid, wherein the device is configured to retain the plurality of containers in a generally circular configuration and the centermost portion of the cavity is suitable for storing a cooling component.

17. A device configured for storing generally cylindrical containers, comprising:

an integrally formed plastic base having a top portion and a bottom portion, the bottom portion forming a cavity;

a plurality of container-retaining pockets molded into the bottom portion of the base, each container-retaining pocket being configured to retain a container having a top portion and a bottom portion at an angle such that the bottom portion of each container is located closer to a center of the device than the top portion;

a centermost portion of the cavity formed by a bottom portion of the base, the centermost portion being positioned at the center of the container retaining pockets;

wherein the base is configured to retain the plurality of containers in a generally circular configuration and the centermost portion of the cavity is suitable for storing a cooling component such that it may come into contact with the plurality of containers, wherein the base is configured such that it may be attached to a lid having at least one raised portion protruding from its top surface that is configured to contain the top portion of each container.

18. The device according to claim 17, wherein the device is configured to contain six containers.

19. The device according to claim 17, wherein the device is configured to store twelve containers.

* * * * *